US010390602B2

(12) United States Patent
Willet, Jr.

(10) Patent No.: US 10,390,602 B2
(45) Date of Patent: Aug. 27, 2019

(54) ELECTRO-MECHANICAL SKIN PULLING, ALTERING AND LIFTING DEVICE WITH OPTIONAL REMOTE CONTROL

(71) Applicant: Robert Phillip Willet, Jr., Glenelg, MD (US)

(72) Inventor: Robert Phillip Willet, Jr., Glenelg, MD (US)

( * ) Notice: Subject to any disclaimer, the term of this patent is extended or adjusted under 35 U.S.C. 154(b) by 475 days.

(21) Appl. No.: 15/337,336

(22) Filed: Oct. 28, 2016

(65) Prior Publication Data

US 2018/0035786 A1 Feb. 8, 2018

Related U.S. Application Data

(60) Provisional application No. 62/371,713, filed on Aug. 5, 2016.

(51) Int. Cl.
*A45D 44/22* (2006.01)
*A41G 5/00* (2006.01)

(52) U.S. Cl.
CPC ..... *A45D 44/22* (2013.01); *A41G 5/0073* (2013.01)

(58) Field of Classification Search
CPC .. A41G 5/0073; A41G 5/0086; A41G 5/0026; A45D 44/22
USPC ..... 606/204.35
See application file for complete search history.

(56) References Cited

U.S. PATENT DOCUMENTS

| | | | | | |
|---|---|---|---|---|---|
| 550,492 | A * | 11/1895 | Ent | A45D 44/22 | 606/204.15 |
| 1,195,117 | A * | 8/1916 | Spellerberg | A45D 44/22 | 606/204.35 |
| 3,524,443 | A * | 8/1970 | Batlin | A45D 44/22 | 132/279 |
| 3,736,925 | A * | 6/1973 | Erman | A45D 44/22 | 24/129 B |
| 3,971,384 | A * | 7/1976 | Hasson | A61B 17/085 | 606/218 |
| 4,239,037 | A * | 12/1980 | Fausone | A45D 44/22 | 606/204.35 |
| 5,067,482 | A * | 11/1991 | Reid | A45D 44/22 | 606/204.35 |
| 5,154,195 | A * | 10/1992 | Irisawa | A41G 5/0026 | 132/201 |
| 6,973,931 | B1 * | 12/2005 | King | A41G 5/0086 | 132/201 |
| 2013/0291888 | A1 * | 11/2013 | Heyniger | A45D 44/22 | 132/278 |
| 2014/0128908 | A1 * | 5/2014 | DeAngelis | A45D 44/22 | 606/204.35 |
| 2018/0027953 | A1 * | 2/2018 | Palmer | A45D 44/22 | |

* cited by examiner

*Primary Examiner* — Matthew F Desanto

(57) ABSTRACT

The present invention is an electro-mechanical external skin pulling device for users to pull/stretch and hold in place their skin in an easy, reliable, safe and predictable manner to enable facial, eye, cheek, neck and/or throat appearance modifications, integrated with an optional wireless remote control adjustment/monitoring system using either a mobile communication device running an application for the present invention or a dedicated remote control device to adjust and maintain the desired skin alteration.

27 Claims, 10 Drawing Sheets

ELECTRO-MECHANICAL SKIN PULLING, ALTERING AND LIFTING DEVICE WITH OPTIONAL REMOTE CONTROL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of cosmetology. More particularly, the present invention is in the technical field of skin alteration. More particularly, the present invention is in the technical field of external non-surgical skin alteration devices.

The objective of skin alteration is to remove or minimize wrinkles and/or to modify features usually on the human face, in a manner that changes (usually improving) one's appearance. This can be accomplished using either an invasive medical procedure usually involving surgery or an external tension device such as tape pulling the skin.

Permanent skin alteration and skin modification is typically performed through invasive surgery by a medical surgeon, usually a plastic surgeon, where the skin is pulled tight and a section of the excess skin is cut-out. The skin sections are then reattached using a series of sutures until the skin regrows back together. This medical procedure is often called a face-lift, neck lift or the like. The medical procedure is very expensive, risky and requires long patient recovery times. Furthermore the resulting alterations are unpredictable as to their final appearance. Often the patient's resulting appearance is distorted. Nerve damage and complications can occur. The procedure and alterations are not reversible.

Other methods of medical skin alteration include external creams, injection of filler and activation substances such as Botox (trademark of Allergan, Inc) into the skin, and laser or ultrasonic or other RF frequency stimulation of the skin and collagen. Each method has varying degrees of questionable success and also varying levels of side effects.

Temporary external skin alteration and skin modification can be performed with mechanical devices as simple as tape sticking to the skin and pulled taught to another area of skin. This crude tape technique has been in use for decades. Problems often occur with trying to hide the tape and the tape pulling loose from the skin. Adjustment consists of reattaching new tape to the skin or retying the band pulling the tape to apply more or less force.

External mechanical devices for skin alteration have historically been granted patents as follows:

PATENT CITATIONS

| Cited Patent | Filing date | Publication date | Applicant | Title |
|---|---|---|---|---|
| U.S. Pat. No. 1,195,117A | Mar. 14, 1913 | Aug. 15, 1916 | Spellerberg, Magarete | Device for removing wrinkles from the face |
| US 2014/0128908A1 | Oct. 30, 2013 | May 8, 2014 | DeAngelis, Lisa | Appearance enhancement system |

These inventions are comprised of a rubber or elastic band/strap wrapped around the back of the human head connecting to a piece of tape or fabric attached to bare skin on each side of the human face or connecting to a clasp device that anchors and pulls hair close to the hairline along each side of the human the face. The patents cited above both rely on a band or other like elongated member to exert the pull force that is routed from one side of the user's head to the opposite side of the head to act as a counterforce mechanism such that the pull force is exerted primarily in a horizontal direction only with little direction adjustment. These simplistic devices have severe shortcomings for practical and convenient attachment and wearing comfort by the user. Adjustment of the skin tension is clumsy and imprecise, either by tying a new adjustment knot in the rubber or elastic band and/or by reattaching the tape or fabric attachment(s) or clasp attachment device in a different position. Furthermore the tape is not camouflaged and is not repositionable and is not reusable. Furthermore the tape is visibly shiny when on skin and loosens easily becoming unstable and often wrinkles with user movements. Furthermore the DeAngelis invention cited previously uses clasp devices that pull on the hair close to the hairline, causing significant user discomfort and can tear hair out of the user's head. Furthermore the rubber or elastic band pulling the tape is not camouflaged and can easily be seen, especially when the user's hair is short and/or when the wind blows the user's hair exposing the rubber or elastic band. Furthermore the rubber or elastic band is not anchored horizontally or vertically-allowing the rubber or elastic band to unexpectedly shift thus allowing the skin tension to inappropriately change. Furthermore skin on the upper part of the face like the forehead and eyes cannot be lifted vertically up as there is no way to pull up and over the top of the head. Furthermore the rubber or elastic band can easily get tangled in the hair as it shifts up and down-bunching and tangling in the user's hair. Furthermore multiple connection points to different skin areas like the face and neck can only be accomplished with multiple rubber or elastic bands. Furthermore the pulling force exerted on the skin is primarily in the horizontal direction only and cannot be exerted vertically. Furthermore as skin is pulled back then the hairline is also pulled back, causing and creating a bare skin area where hair was previously. In summary, these devices are not reliable, difficult to apply, not easily hidden/camouflaged, limited in their effectiveness and can cause significant discomfort.

BRIEF SUMMARY OF THE INVENTION

The present invention is an electro-mechanical external skin pulling device for users to pull/stretch and hold in place their skin to enable facial, eye, cheek, neck and/or throat appearance modifications, integrated with an optional wireless remote control adjustment/monitoring system to adjust and maintain the desired skin alteration.

DETAILED DESCRIPTION OF THE INVENTION

Figure 1:
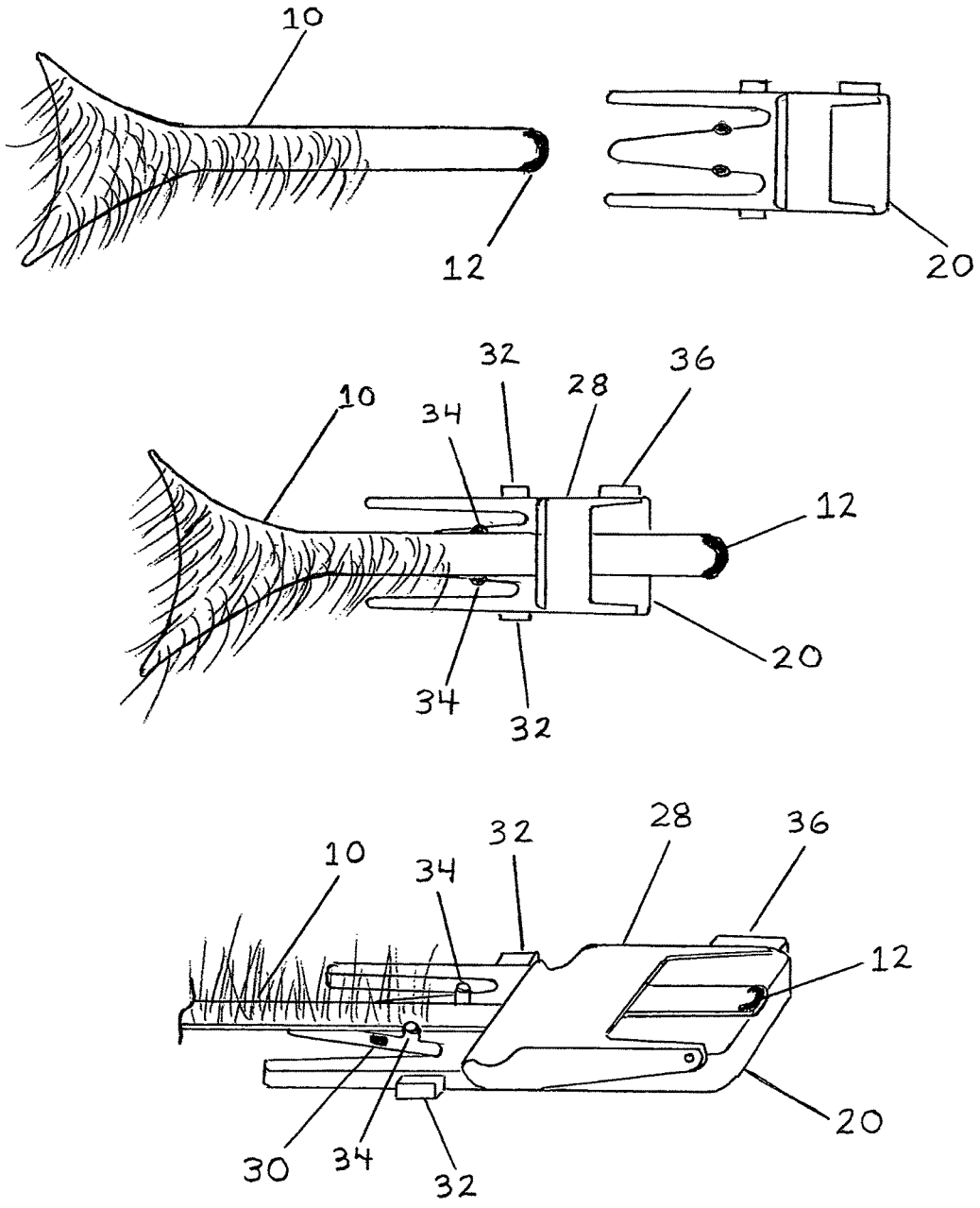
FIG. 1 is a perspective of elements of manual hair anchor version of an electro-mechanical skin pulling device of the present invention.
Figure 2:
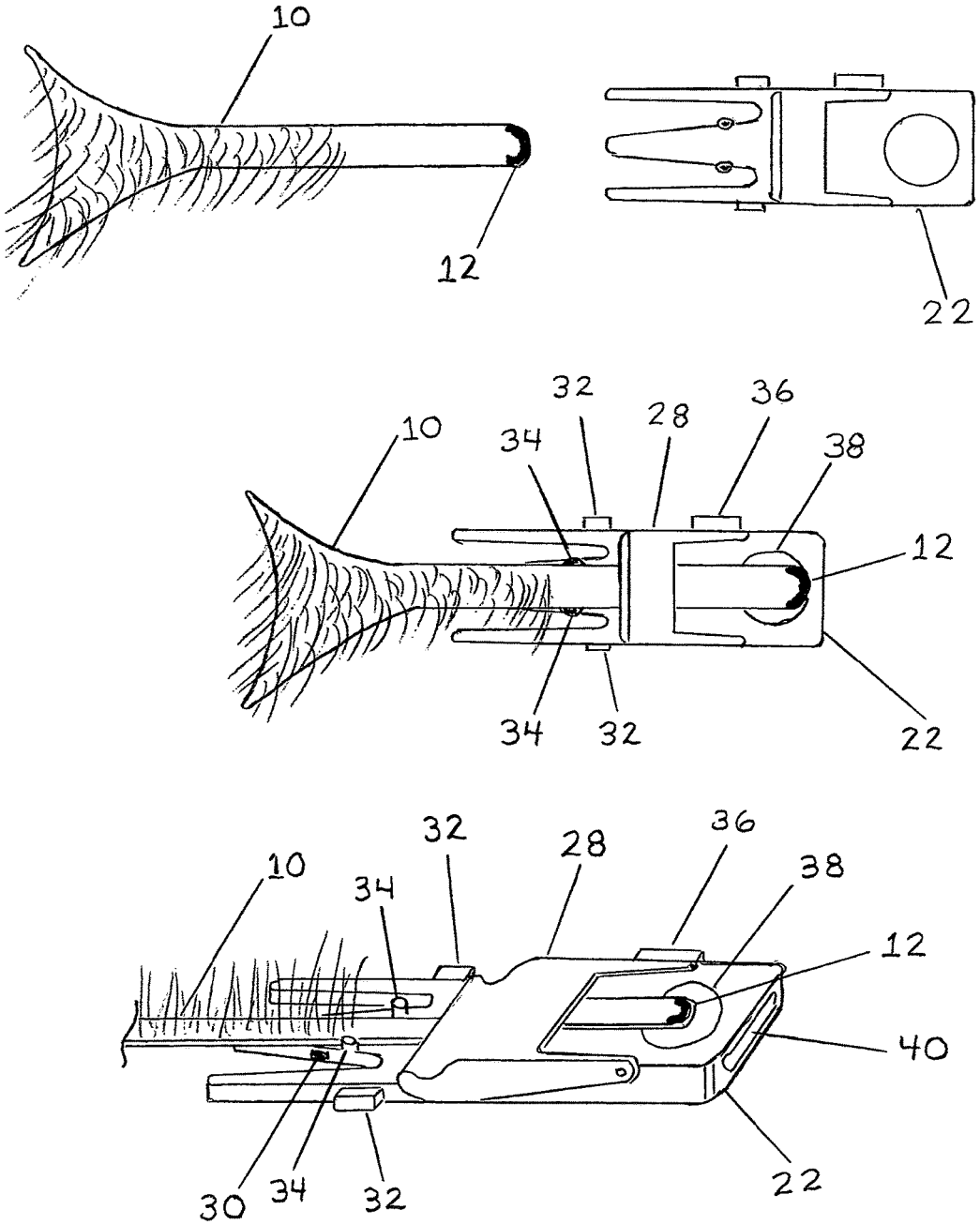
FIG. 2 is a perspective of elements of remote control hair anchor version of an electro-mechanical skin pulling device of the present invention.
Figure 3:
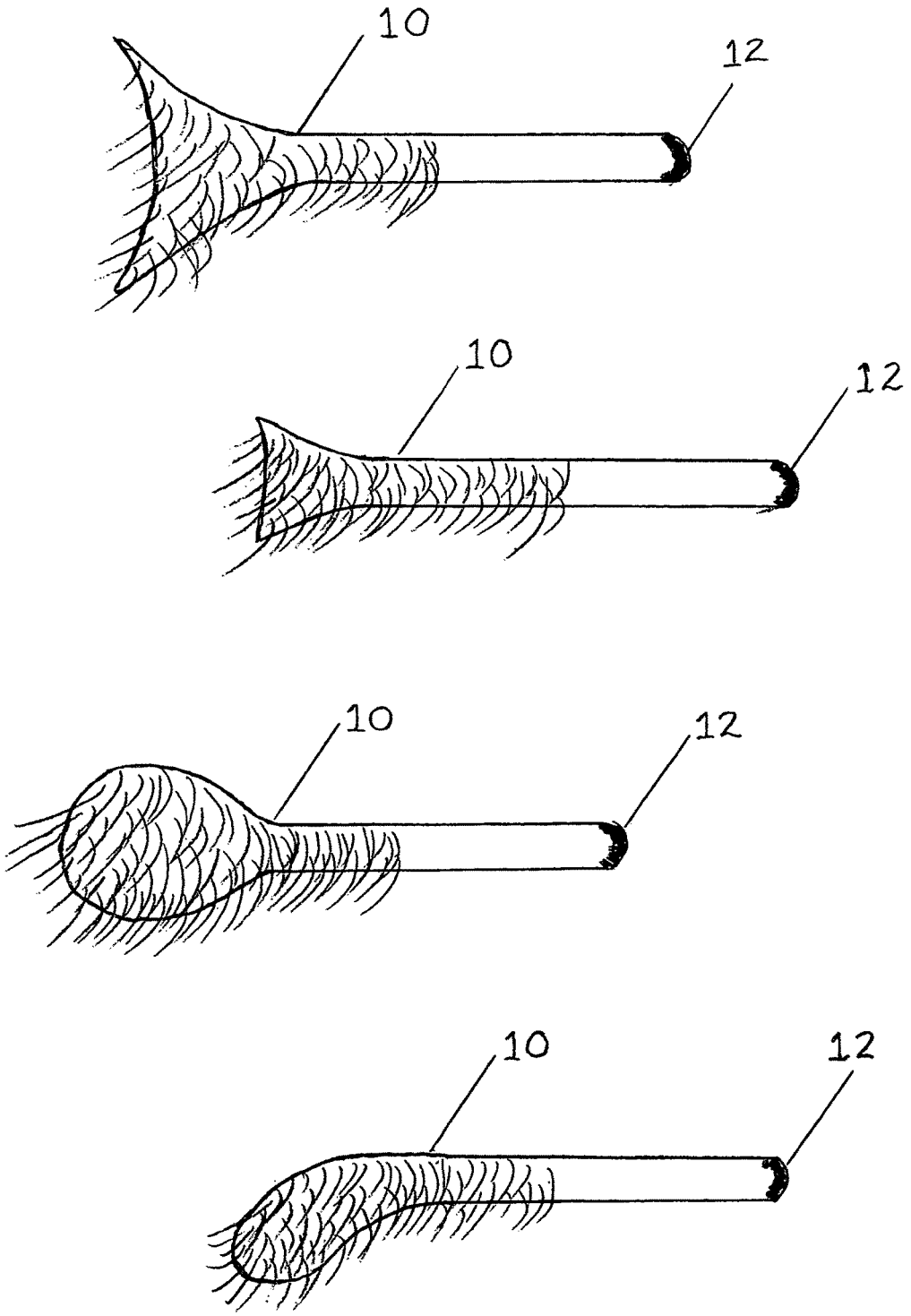
FIG. 3 is a perspective of various skin pulling flap shapes of an electro-mechanical skin pulling device of the present invention.
Figure 4:
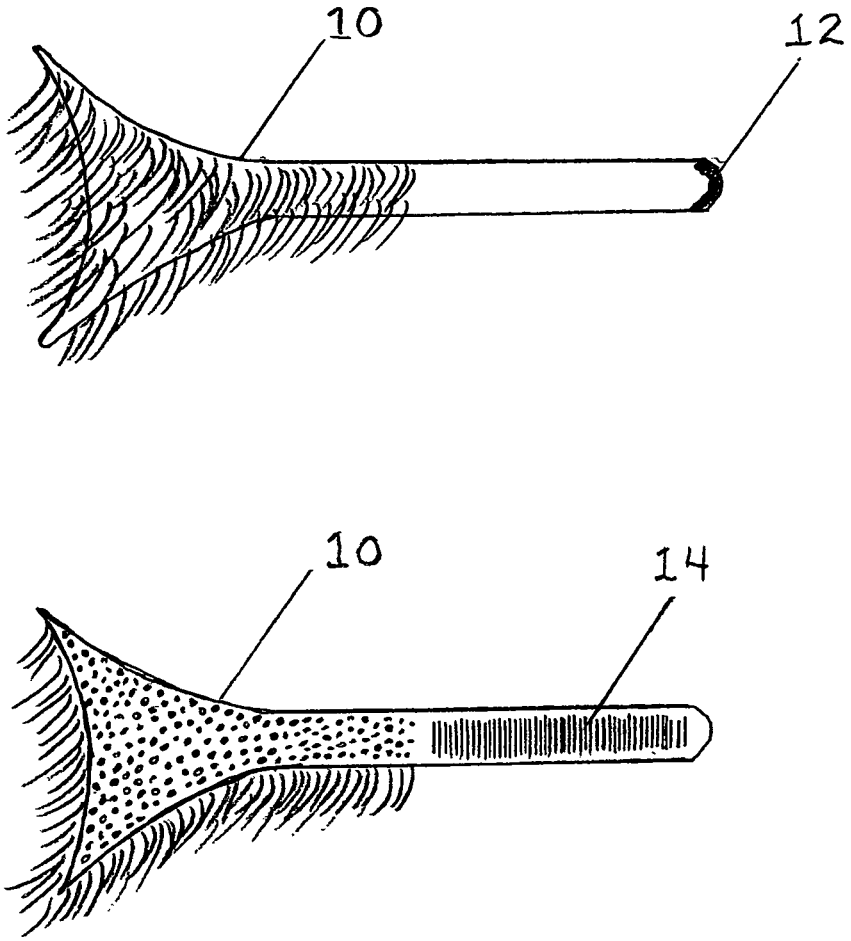
FIG. 4 is a perspective of skin pulling flap with bar code markings of an electro-mechanical skin pulling device of the present invention.
Figure 5:
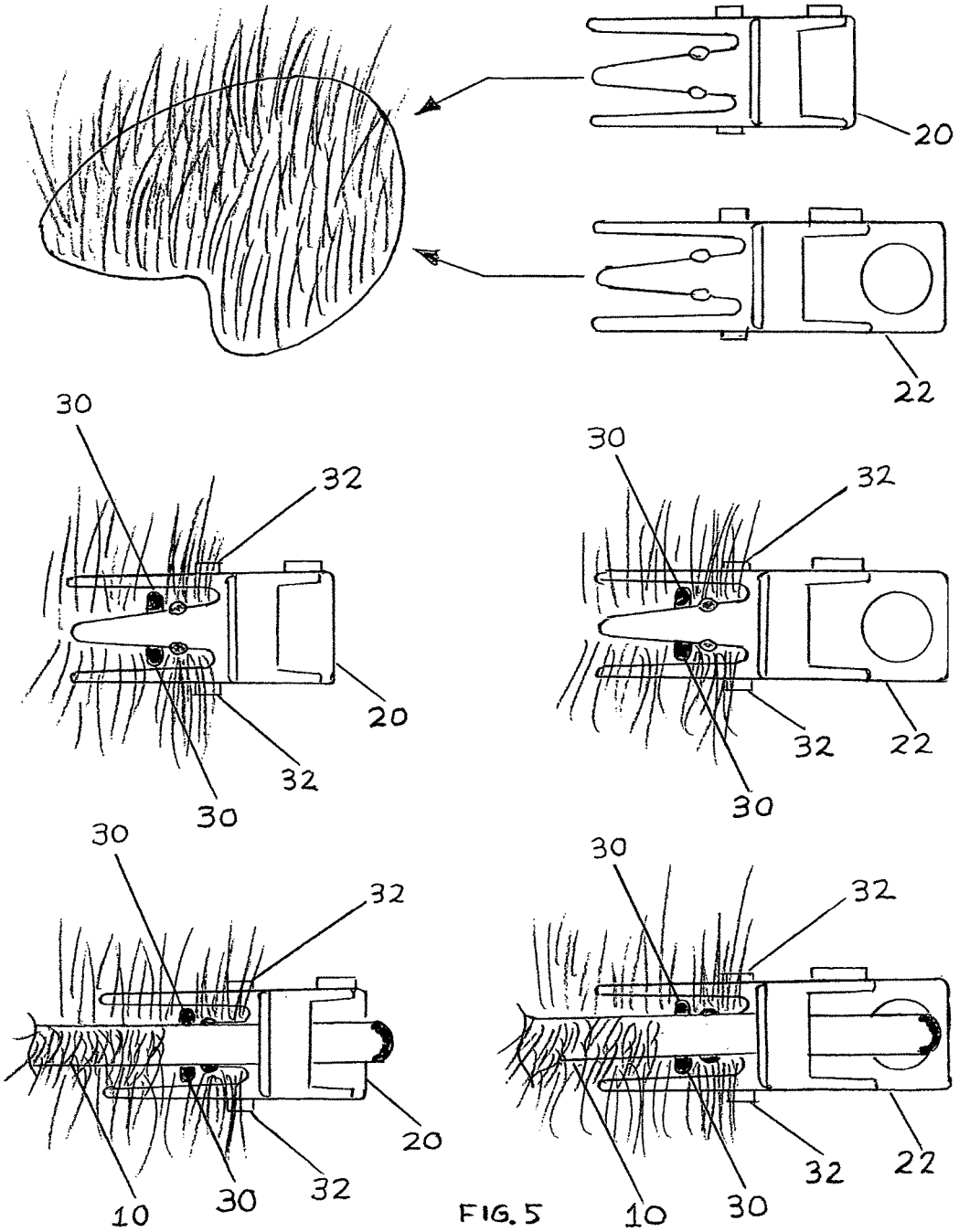
FIG. 5 is a perspective of manual hair anchor and remote control hair anchor locking onto user's hair of an electro-mechanical skin pulling device of the present invention.
Figure 6:
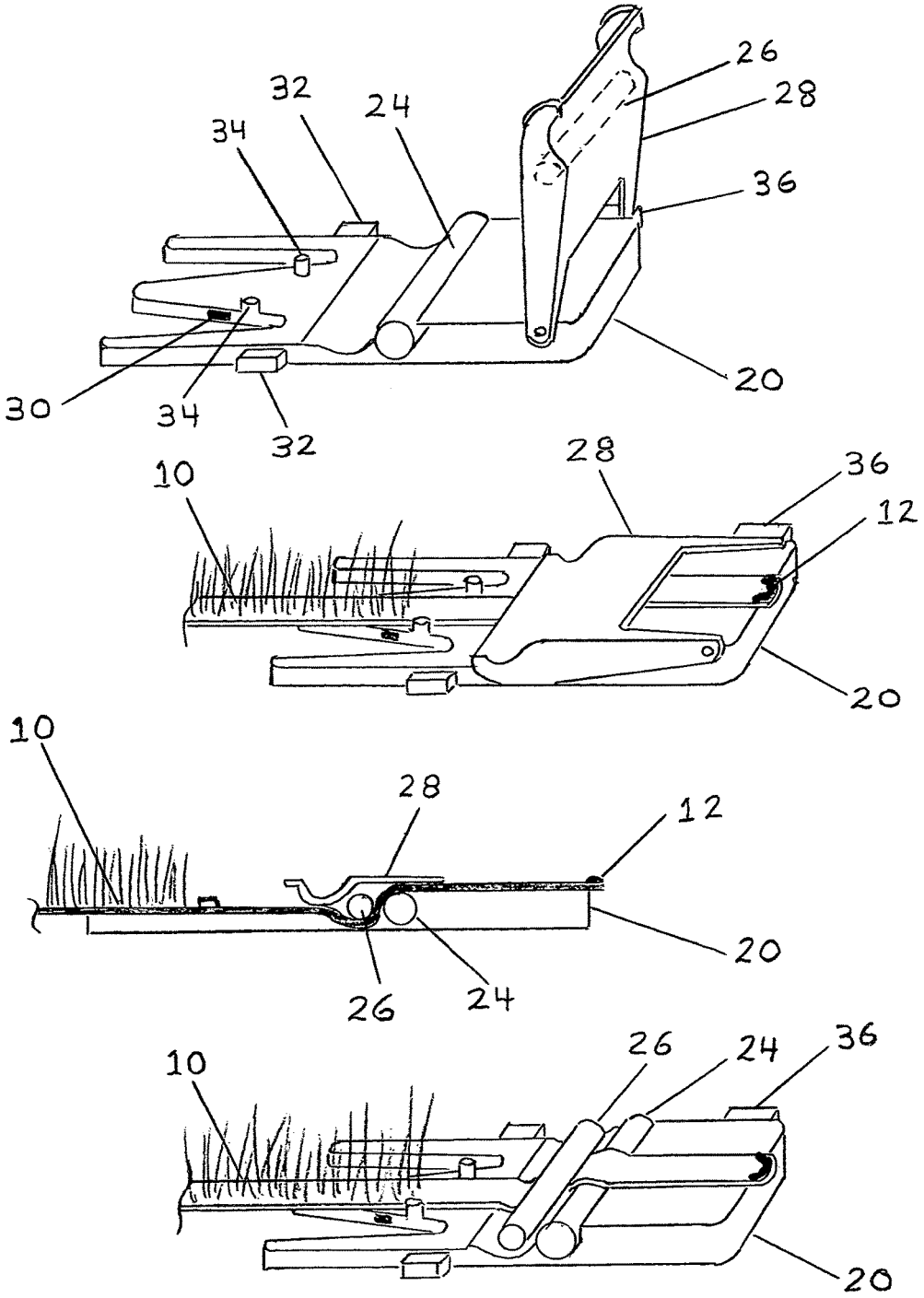
FIG. 6 is a perspective and cutaway perspective of roller drive system within the manual hair anchor of an electro-mechanical skin pulling device of the present invention.
Figure 7:
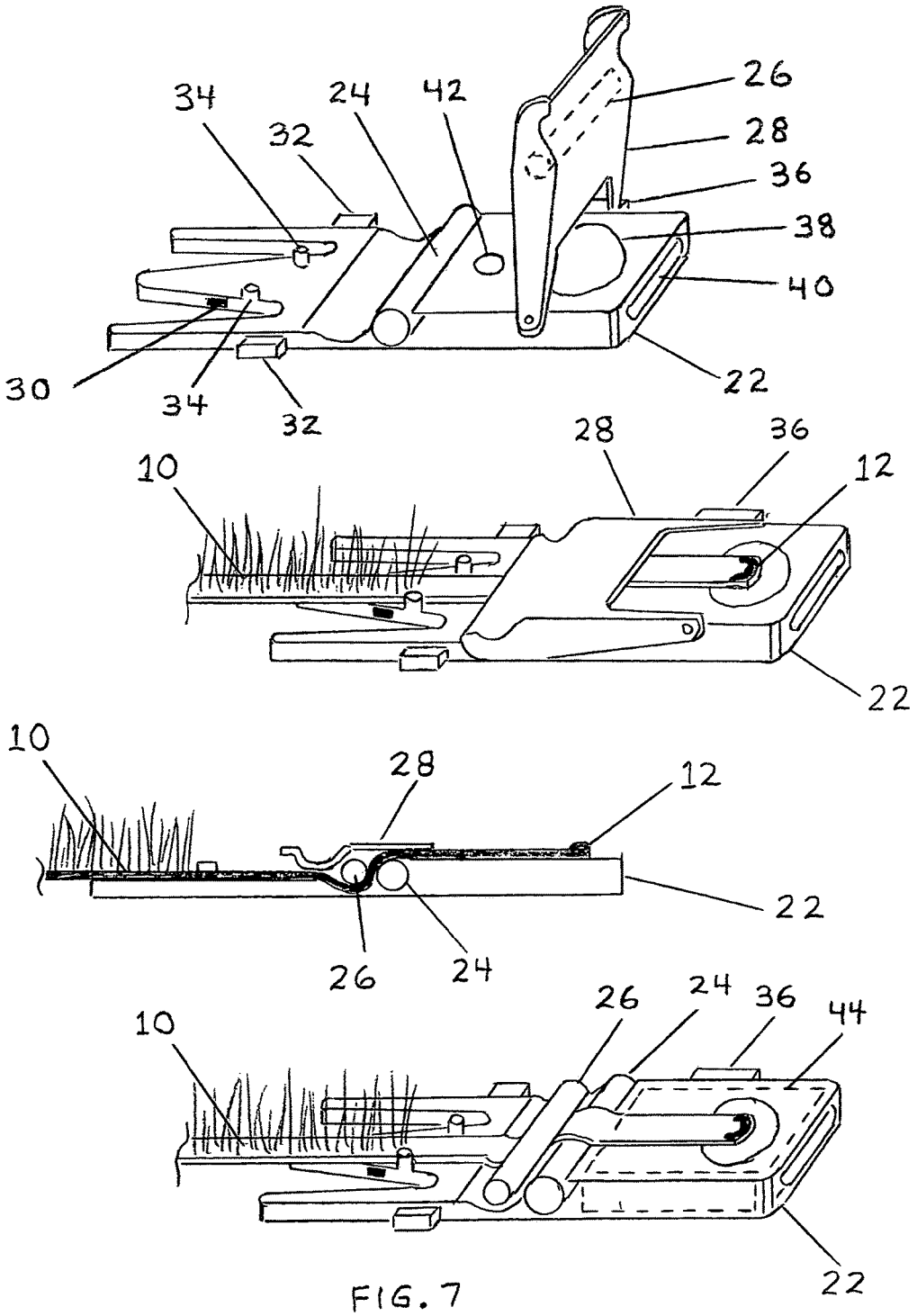
FIG. 7 is a perspective and cutaway perspective of roller drive system within the remote control hair anchor of an electro-mechanical skin pulling device of the present invention.
Figure 8:
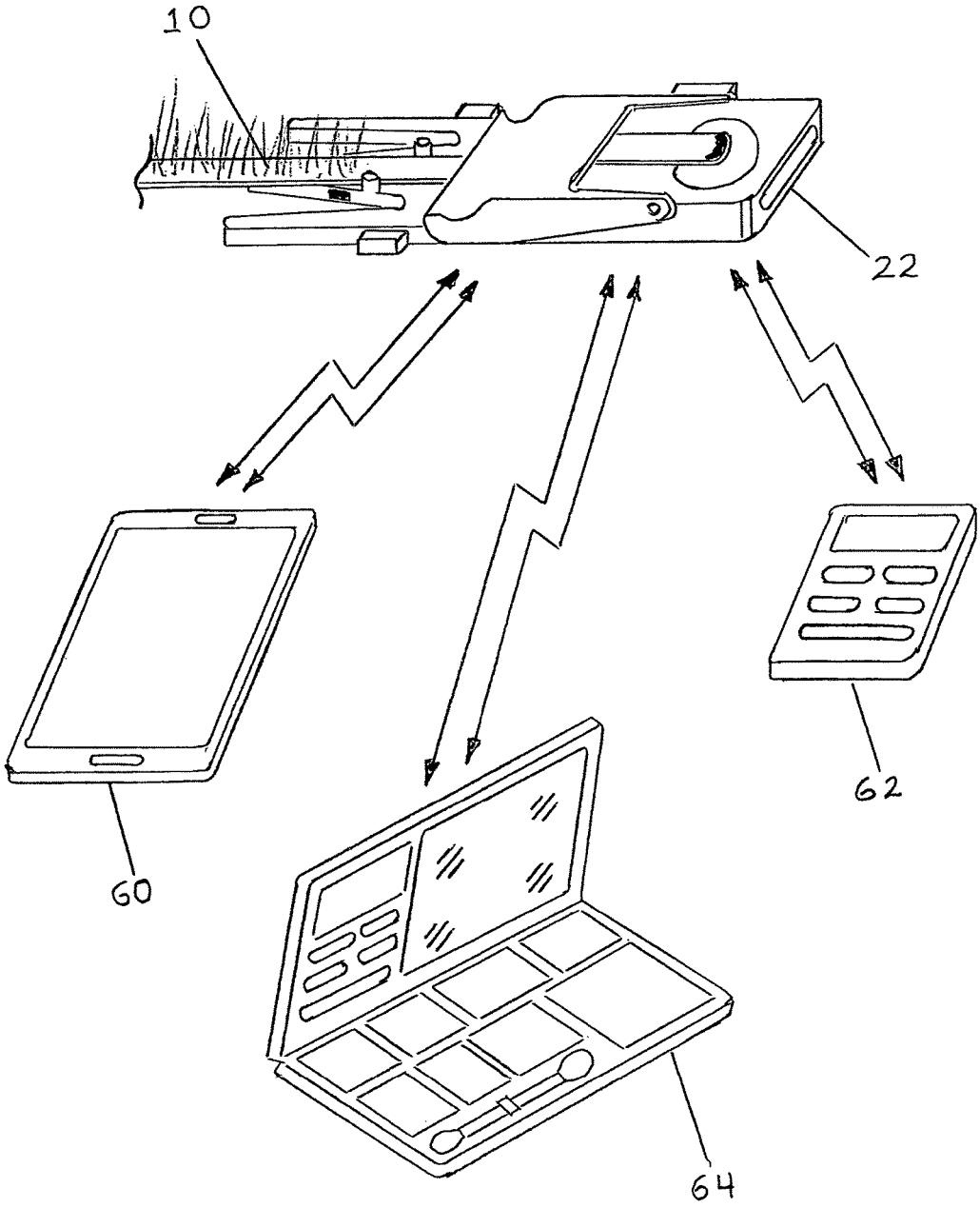
FIG. 8 is a perspective of a mobile communication device, dedicated remote control device and cosmetic case device wirelessly communicating with a remote control hair anchor of an electro-mechanical skin pulling device of the present invention.
Figure 9:
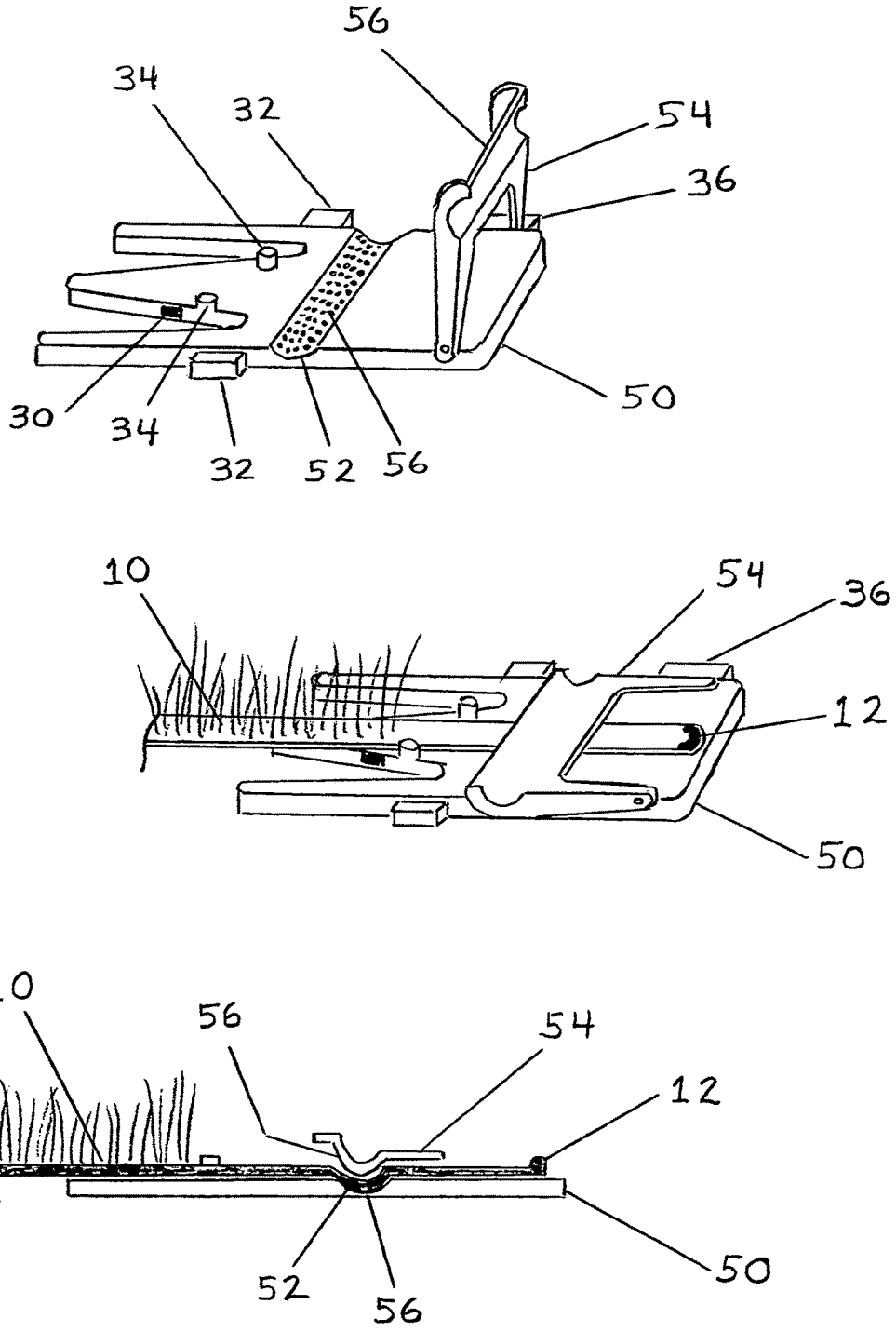
FIG. 9 is a perspective and cutaway perspective of an alternate design using a friction gripping system within the manual hair anchor of an electro-mechanical skin pulling device of the present invention.
Figure 10:
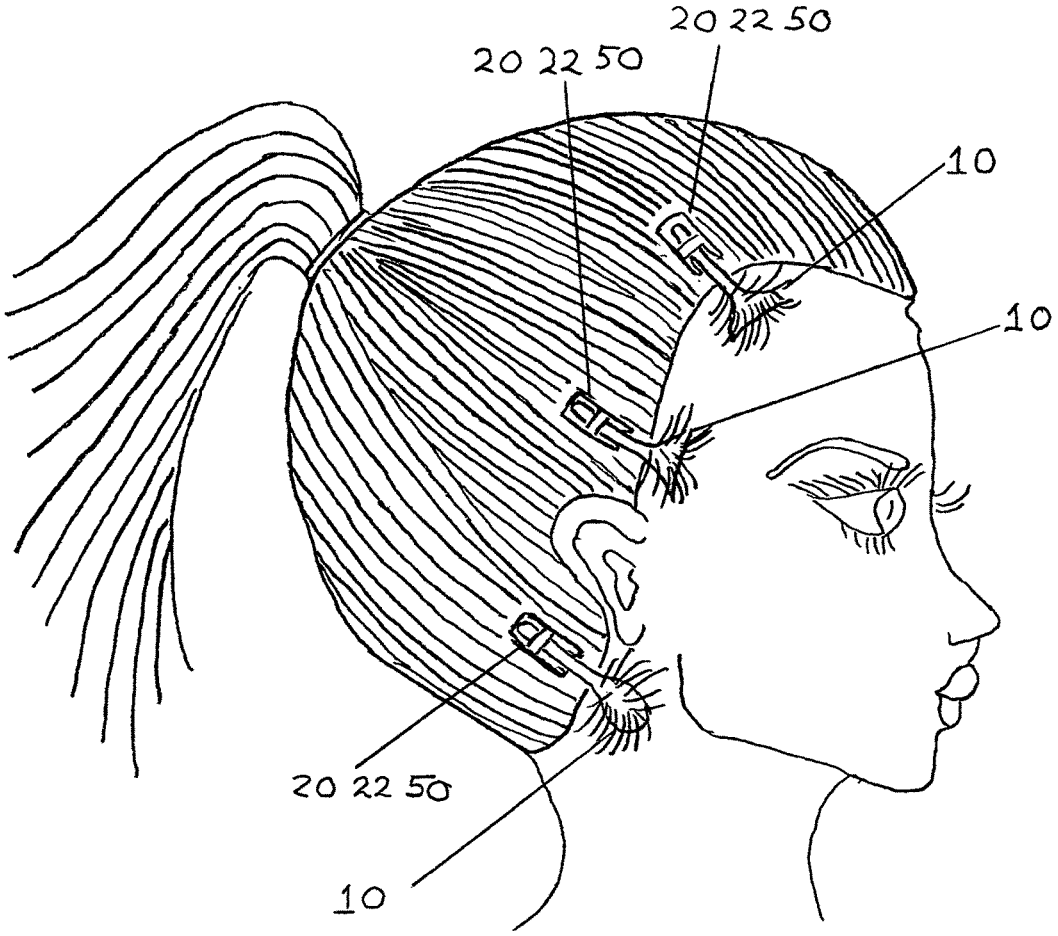
FIG. 10 is a side view of multiple electro-mechanical skin pulling devices in place on a human head and neck of the present invention.

Referring now to the invention in more detail, in FIG. 1 to FIG. 10 there is shown an electro-mechanical skin pulling device having a two-piece design consisting of skin pulling flap 10 as the first element that connects to the user's bare skin and either a manual hair anchor 20 or a remote control hair anchor 22 as the second element that is anchored to the user's hair. Skin pulling flap 10 has a first end and a second end. The first end of the skin pulling flap 10 is shaped to match the contour of the user's hairline area and is attached to the user's bare skin just outside of the hairline on the head or neck, using glue or a double-sided glue strip. Skin pulling flap 10 is a single piece of material formed from a soft pliable flat material that is partially or entirely injected with hair or embedded with hair or punched with hair or with hand sewn hair protruding out from the material on one side and a flat smooth surface on the opposite side of the material. The second end of skin pulling flap 10 has an elongated flat shape that connects to and is pulled by either manual hair anchor 20 or remote control hair anchor 22 as the second element and has an elevated edge 12 at the tip of the second end of skin pulling flap 10 for easy grasping of the skin pulling flap 10 by the user. Manual hair anchor 20 has a first end and a second end. Remote control hair anchor 22 has a first end and a second end. The first end of manual hair anchor 20 is identical to the first end of remote control hair anchor 22 and is shaped like modified prongs on a fork with an internal sliding actuator bar that when activated by the user, closes off a portion of the channel between the fork-like prongs, by pushing out a spring loaded blocking protrusion/gate 30 into each channel. Manual hair anchor 20 or remote control hair anchor 22 is held fixed in place on the user's head by sliding the first end of manual hair anchor 20 or remote control hair anchor 22 with the modified fork-like prongs into the user's hair next to the scalp filling the channels between prongs with the user's hair. The user then presses hair lock button 32 located on the side of manual hair anchor 20 or on the side of remote control hair anchor 22, that then mechanically moves the internal sliding actuator bar that then presses out and slides closer the spring loaded blocking protrusion/gate 30 into each channel which closes off a portion of the channel between fork-like prongs, but leaving an opening in the channel at the point where the fork-like prongs attach to the second end of manual hair anchor 20 or the second end of remote control hair anchor 22, thereby capturing and trapping the user's hair into the channel opening and grasping the hair so that manual hair anchor 20 or remote control hair anchor 22 is fixed in place. The second end of manual hair anchor 20 is an enclosure containing a roller drive system consisting of two rollers that the flat surface of the second end of skin pulling flap 10 rolls between. The first roller on manual hair anchor 20 is a drive roller 24 with a slightly rough contact surface for improved gripping and the second roller on manual hair anchor 20 is an idler roller 26 with a smooth contact surface. Idler roller 26 is mounted on and freely rotates on spring loaded shield/guide 28, with the idler roller 26 being pushed against the drive roller 24 from the force being exerted by the spring loaded shield/guide 28 on idler roller 26. Shield/guide 28 also prevents user hair from entering the roller drive system and helps guide the skin pulling flap 10 into the roller drive system on the first end of manual hair anchor 20 and then guides the skin pulling flap 10 to exit the roller drive system back out over the second end of manual hair anchor 20. The second end of skin pulling flap 10 is manually pulled by the user between the rollers on manual hair anchor 20 and when the skin pulling flap 10 is released by the user, the drive roller 24 on manual hair anchor 20 locks using a ratchet mechanism, thereby reliably and securely holding skin pulling flap 10 fixed and locked between the rollers on manual hair anchor 20 and thus maintaining the desired pull/tension force on the user's skin through skin pulling flap 10. The drive roller 24 on manual hair anchor 20 also winds a torsion spring as skin pulling flap 10 is pulled through manual hair anchor 20 as the drive roller 24 rotates. The pull/tension force on the user's skin is released by pressing flap release button 36 located on the side of manual hair anchor 20, that then releases the ratchet mechanism holding drive roller 24 on manual hair anchor 20 and the wound torsion spring unwinds and rotates the drive roller 24, thereby driving the second end of skin pulling flap 10 out of manual hair anchor 20 and releasing the pull/tension force on the user's skin while moving skin pulling flap 10 into a released position. An alternate design for the second end of manual hair anchor 20 is shown in FIG. 9 depicting manual hair anchor 50 where the roller drive system is removed from manual hair anchor 20 and replaced with a friction gripping system in the second end of manual hair anchor 50 consisting of cylindrical depression 52 in manual hair anchor 50 that has an outer rough contact surface 56 and the curved contact surface of spring loaded shield/guide 54 has an outer rough contact surface 56 such that when spring loaded shield/guide 54 is closed and engaged, the second end of skin pulling flap 10 is pressed into cylindrical depression 52 and pinched between the rough contact surface 56 of cylindrical depression 52 and the rough contact surface 56 of the curved contact surface of spring loaded shield/guide 54, such that skin pulling flap 10 is securely held fixed in position and thus maintaining the desired pull/tension force on the user's skin through skin pulling flap 10. The second end of remote control hair anchor 22 is an enclosure containing multiple subsystems, as follows: 1) roller drive system consisting of two rollers that the flat surface of the second end of skin pulling flap 10 rolls between; 2) direct current electric motor with reduction gear system to rotate the drive roller 24; 3) programmable electronic microcontroller; 4) RF (radio frequency) electronic transmitter/receiver with antenna; 5) pressure sensor to measure the pull/tension force being exerted on the skin pulling flap 10; 6) speed/rotation sensor to measure the rotation and direction motion of the drive roller 24; 7) recognition sensor 42 to measure the linear movement of the skin pulling flap 10; 8) position switch/sensor to monitor the spring loaded shield/guide 28 position; 9) internal temperature sensor; 10) push button switch 38 that the user presses to initiate actions; 11) audible noise generator; 12) power saving circuitry; and 13) one or more removable and replaceable miniature battery. The first roller on remote control hair anchor 22 is a drive roller 24 with a slightly rough contact surface for improved gripping and the second roller on remote control hair anchor 22 is an idler roller 26 with a smooth contact surface. Idler roller 26 is mounted on and freely rotates on spring loaded shield/guide 28, with the idler roller 26 being pushed against the drive roller 24 from the force being exerted by the spring loaded shield/guide 28 on idler roller 26. Shield/guide 28 also prevents user hair from entering the roller drive system and helps guide the skin pulling flap 10 into the roller drive system on the first end of remote control hair anchor 22 and then guides the skin pulling flap 10 to exit the roller drive system back out over the second end of remote control hair anchor 22. The drive roller 24 on remote control hair anchor 22 is driven by a miniature electric motor with a miniature reduction gear system to generate the required torque to rotate the drive roller 24 and to turn the drive roller 24 at the correct rotational speed. The electric motor can rotate the drive roller 24 in either a clockwise or counterclockwise direction. The rotational speed of the electric motor and therefore the rotational speed of the drive roller 24 is variable and controlled by the microcontroller. The second end of skin pulling flap 10 is placed between the rollers on remote control hair anchor 22. The user then using an RF (radio frequency) communication/frequency enabled device with security encryption (like Bluetooth) such as a mobile phone 60 that is running an application for the present invention or alternately a dedicated remote control device 62, communicates to the microcontroller in remote control hair anchor 22 to perform any of the following actions: 1) increase the pull/tension force on skin pulling flap 10 by activating the electric motor and rotating drive roller 24 clockwise; 2) decrease the pull/tension force on skin pulling flap 10 by activating the electric motor and rotating drive roller 24 counterclockwise; or 3) deactivate electric motor to lock stationary skin pulling flap 10 at the current position. The microcontroller contained in remote control hair anchor 22 has sensors that can measure the following: 1) pressure sensor measures the pull/tension force being exerted on skin pulling flap 10 to automatically set and maintain the force being exerted on skin pulling flap 10 at a preset or stored level and as a safety measure to prevent too much pull/tension force being applied to skin pulling flap 10; 2) recognition sensor 42 detects movement of the skin pulling flap 10 to sense motion, direction and end points of the second end of skin pulling flap 10; 3) sensor measures the rotation speed and direction of drive roller 24; 4) switch/sensor detects the position of spring loaded shield/guide 28; and 5) sensor measures the internal temperature of the electronics contained within the second end of remote control hair anchor 22 as a safety measure. The microcontroller activates an audible noise generator to audibly signal the user when prompted to do so by a user's action. The microcontroller communicates with the user's mobile communication device or dedicated remote control device 62 through an RF (radio frequency) electronic transmitter/receiver with an embedded internal antenna. Pressing flap release button 36 located on the side of remote control hair anchor 22 mechanically disengages the drive roller 24 by releasing the force holding the idler roller 26 against the drive roller 24 if quick disengagement and release of the pull/tension force is desired by the user. The application software for this electro-mechanical skin pulling device running on the user's mobile communication device such as a mobile phone 60 communicates with the remote control hair anchor 22 using an RF (radio frequency) communication protocol/frequency (such as Bluetooth) and can simultaneously handle up to 16 skin pulling flap 10/remote control hair anchor 22 pairs simultaneously on the user while also displaying the user's face on the mobile communication device as if looking into a mirror, such that the user can adjust the skin pull/tension force while simultaneously watching their face/neck on the mobile communication device's display screen. Dedicated remote control device 62 can be embedded into other complimentary cosmetic devices, both fixed, portable and foldable, such as a cosmetic makeup case, cosmetic tote bag or cosmetic compact makeup case 64 containing the dedicated remote control device 62 and a mirror, makeup and other cosmetic items; thus permitting the user to adjust the skin pull/tension force being applied to their face and neck while simultaneously watching the adjustment actually occurring on their face and neck in the mirror contained in their cosmetic case device. Typically the electro-mechanical skin pulling device is used in pairs with the second electro-mechanical skin pulling device located on the side directly opposite of the first electro-mechanical skin pulling device on the user's head or neck. For example one electro-mechanical skin pulling device is attached at the user's left temple area and the second electro-mechanical skin pulling device is attached at the user's right temple area, to pull the skin in the general eye and upper face areas on both sides of the face in unison. The mechanism contained within the first end of manual hair anchor 20 and remote control hair anchor 22 and the mechanism contained within the second end of manual hair anchor 20 or remote control hair anchor 22, can be separated and individually incorporated into other anchoring devices such as clips, clasps, barrettes, head bands, wigs, toupees or other hair attachment devices. The mechanism contained within the first end of manual hair anchor 20 and remote control hair anchor 22 and the mechanism contained within the second end of manual hair anchor 20 or remote control hair anchor 22, can be separated and multiples of either mechanism or in combination, can be incorporated onto one device such as a head band that the user can wear in or over the user's hair and connect to one or more skin pulling flaps 10 simultaneously.

In more detail, still referring to the invention of FIG. 1 to FIG. 10, there is shown an electro-mechanical skin pulling device having a simple two-piece design consisting of skin pulling flap 10 as the first element and manual hair anchor 20 or remote control hair anchor 22 as the second element. Skin pulling flap 10 is formed from an elongated single piece of material having a first end and a second end; and functions to: 1) securely attach skin pulling flap 10 to the user's skin; and 2) transmits the entire pulling/tension force point to point directly between the skin attachment point on the user's skin to manual hair anchor 20 or remote control hair anchor 22 as the final end anchoring point. The first end of skin pulling flap 10 is attached using glue or a double-sided glue strip to the bare skin on the user's head or neck in the location where the user wants the skin to be pulled. The glue used for attachment of skin pulling flap 10 is designed for human skin contact such as medical grade glue for skin attachment or spirit gum or wig lace glue or other like glue substance. The double-sided glue strip used for attachment of skin pulling flap 10 is designed for human skin contact such as wig lace glue strip or other like glue strip material formed from compressed glue in a convenient flexible attachment strip. Glue creates a stronger bond to the user's skin versus all other attachment methods and is waterproof; therefore skin pulling flap 10 remains attached to the user's skin when wet while showering or dampened from user perspiration. The attachment area is bare skin just outside of the hairline. Before application of skin pulling flap 10, the user's skin can be prepped with alcohol or similar substance, to remove oil, makeup and other substances present on the surface of the skin, thereby improving the glue adhesion of the skin pulling flap 10 to the user's skin. The first end of skin pulling flap 10 is shaped in the contour of the user's hairline. Size and shape of the first end of skin pulling flap 10 is determined by multiple functions, those functions being: 1) shape of first end of skin pulling flap 10 has sufficient adhesion area to achieve a secure bond to the user's skin capable of remaining intact with the pull/tension force being exerted on skin pulling flap 10; 2) shape of first end of skin pulling flap 10 is wide enough along the hairline to pull the entire breadth of skin necessary to achieve the alteration desired on that part of the user's face or neck; 3) shape of first end of skin pulling flap 10 structurally distributes the pulling force being applied to skin pulling flap 10 evenly across the entire breadth of skin necessary along the hairline to achieve the alteration desired on that part of the user's face or neck; and 4) shape of first end of skin pulling flap 10 matches and follows the user's actual hairline so to blend in and look most natural on the user. Size and shape of the first end of skin pulling flap 10 can be trimmed with scissors by the user. The second end of skin pulling flap 10 has an elongated and flat shape that connects to and is pulled by the second element manual hair anchor 20 or remote control hair anchor 22. The tip of the second end of skin pulling flap 10 has an elevated edge 12 that allows for easy grasping of the skin pulling flap 10 by the user and so the user can more easily find the actual end of skin pulling flap 10 by touch. Skin pulling flap 10 is a single piece of material formed from a soft pliable flat material that is partially or entirely injected with hair or embedded with hair or punched with hair or with hand sewn hair protruding out from the material on one side and a flat smooth surface on the opposite side of the material. This soft pliable flat material that skin pulling flap 10 is manufactured from is formed from polyurethane or latex or nylon or polyester or polymer or silicone or rubber or sponge or plastic or like formulation that is manufactured as a mesh internal structure that is coated with a surface formulation that creates a surface that will grip the user's skin and provide sufficient friction for the roller drive system in manual hair anchor 20 or remote control hair anchor 22 to grasp. The soft pliable flat material is colored to match the user's natural skin tone or is nearly clear so as to be transparent or semi-transparent; with the attached hair being colored to match the user's hair color of choice. The soft pliable flat material does not wrinkle and contours and flexes with user motions that shifts the user's skin such as facial expressions. The soft pliable flat material is like an extension of the user's own skin and being soft and pliable, does not cause uncomfortable abrasion or chaffing of the user's skin. The soft pliable flat material absorbs most of the glue applied by the user, thereby leaving minimal glue residue on the user's skin when skin pulling flap 10 is removed for easier cleanup and minimizes the glue on the edges of skin pulling flap 10 that can catch and hold dirt, makeup and other substances that could create an undesirable visible dark line along the edge of skin pulling flap 10. Hair projecting from the soft pliable flat material is human hair or animal fur hair or artificial hair or artificial fur hair and is attached and angled so the hair naturally lays in the same direction and orientation as the user's own natural hair. Hair projecting from the soft pliable flat material can have any practical length and serves to disguise and hide skin pulling flap 10 from being seen and/or to fill in and provide longer lengths of simulated hair to compliment the user's own hair. Furthermore hair projecting from the soft pliable flat material serves to fill-in and extend hair along the hairline onto bare skin areas where the user desires additional hair and/or where the hairline has been pulled back by the pull/tension force being exerted on the skin by attached skin pulling flap 10 and the user desires to fill-in and extend the hairline to recreate the original hairline, thereby providing a hairline extension or a secondary hairline of realistic looking hair. Furthermore hair projecting from the soft pliable flat material is trimmed to have the same realistic appearance and characteristics as does the hair along the user's own natural hairline on selected edges of skin pulling flap 10; with such characteristics as having finer hair, thinner hair and more baby-like hair. The thickness of the soft pliable flat material tapers from the normal thickness to a much thinner thickness along selected edges of skin pulling flap 10 to provide a realistic transition appearance from soft pliable flat material to bare skin, where the skin pulling flap 10 is attached to the user's skin. Skin pulling flap 10 is reusable therefore permitting skin pulling flap 10 to be removed and reattached repeatedly by the user. Skin pulling flap 10 is cleaned, refreshed and sanitized with a cleaning agent to remove residual old glue from the attachment surface. The smooth side of the second end of skin pulling flap 10 that slides over the outer surface of manual hair anchor 20 and remote control hair anchor 22 has a series of bar code markings 14 imprinted or molded onto the skin pulling flap 10 surface that recognition sensor 42 on remote control hair anchor 22 can detect, allowing the microcontroller in remote control hair anchor 22 to measure the linear motion, direction and end points of skin pulling flap 10. Manual hair anchor 20 and remote control hair anchor 22 are formed from metal, plastic, polymer, nylon, rubber, carbon fiber or other like material colored to match the user's natural skin tone or colored to match the user's hair color of choice. Manual hair anchor 20 and remote control hair anchor 22 are formed with a slightly curved flat shape along its length. Manual hair anchor 20 has a first end and a second end. Remote control hair anchor 22 has a first end and a second end. The first end of manual hair anchor 20 is identical to the first end of remote control hair anchor 22. The purpose of the first end of manual hair anchor 20 and remote control hair anchor 22 is to grasp onto the user's hair and serve as a fixed anchor point on the user's head. The first end of manual hair anchor 20 and remote control hair anchor 22 is shaped like modified prongs on a fork with typically three prongs. The outer prongs are typical of those on a traditional fork being narrow at the outer end and becoming slightly larger as they connect to the main body of manual hair anchor 20 and remote control hair anchor 22 and are of a solid material construction. The center prong is narrow at the end and widens significantly where the center prong is connected to the main body of manual hair anchor 20 and remote control hair anchor 22 and has a hollowed cavity contained within it. This modified fork-like prongs configuration on the first end of manual hair anchor 20 and remote control hair anchor 22 when swept into the user's hair next to the scalp, directs the user's hair into the narrower part of the two channels between prongs on the outer sides of the manual hair anchor 20 and remote control hair anchor 22, and thus leaves the center portion of the center prong free of user hair at the location where the second end of skin pulling flap 10 slides over, and thus does not drag or snag user hair into the roller drive system on the second end of manual hair anchor 20 and remote control hair anchor 22. Manual hair anchor 20 and remote control hair anchor 22 when placed into the user's hair is oriented in line with the direction the user desires the skin pulling flap 10 to be pulled, with the modified fork-like prongs on the first end of manual hair anchor 20 and remote control hair anchor 22 pointing towards the point at which the skin pulling flap 10 is attached to the user's skin. The center prong has two flap guide posts 34 that rise above the center prong surface at the edges that serve as guides to direct the second end of skin pulling flap 10 between them as the skin pulling flap 10 moves in and out of the roller drive system on the second end of manual hair anchor 20 and remote control hair anchor 22. Contained within the first end of manual hair anchor 20 and remote control hair anchor 22 is an internal sliding actuator bar that when activated by the user, closes off a portion of the channel between the fork-like prongs, by pushing two spring loaded blocking protrusion/gates 30 contained within the hollow cavity of the center prong through an opening in the side of the center prong, into each channel. Manual hair anchor 20 or remote control hair anchor 22 is held fixed in place on the user's head by sliding the first end of manual hair anchor 20 or remote control hair anchor 22 with the modified fork-like prongs into the user's hair next to the scalp filling the channels between prongs with the user's hair. The user then presses hair lock button 32 located on the side of manual hair anchor 20 or the side of remote control hair anchor 22, that then mechanically moves the internal sliding actuator bar that then presses out and slides closer the spring loaded blocking protrusion/gate 30 into each channel which closes off a portion of the channel between fork-like prongs, but leaving an opening in the channel at the point where the fork-like prongs attach to the second end of manual hair anchor 20 or the second end of remote control hair anchor 22, thereby capturing and trapping the user's hair into the channel opening and grasping the hair so that manual hair anchor 20 or remote control hair anchor 22 is fixed in place. The blocking protrusion/gate 30 in each channel is retracted when the user presses hair lock button 32 located on the opposite side of manual hair anchor 20 and remote control hair anchor 22, that then mechanically moves the internal sliding actuator bar in the opposite direction and thereby retracting the blocking protrusion/gate 30 in each channel and releasing the user's hair. Each blocking protrusion/gate 30 is mounted on a metal or a plastic arm that has a flexible spring property which allows the blocking protrusion/gate 30 in each channel to automatically retract as a safety precaution, due to excessive force being exerted on blocking protrusion/gates 30 if manual hair anchor 20 or remote control hair anchor 22 is pulled out of position by the user or by some other action without the user first manually retracting the channel blocking protrusion/gates 30. The purpose of the second end of manual hair anchor 20 and remote control hair anchor 22 is to grasp the second end of skin pulling flap 10 and apply more pull/tension force to skin pulling flap 10 or reduce the pull/tension force on skin pulling flap 10 or to maintain/lock the current pull/tension force on skin pulling flap 10. The second end of manual hair anchor 20 is an enclosure containing a roller drive system consisting of two rollers that the flat surface of the second end of skin pulling flap 10 rolls between. The first roller on manual hair anchor 20 is a drive roller 24 with a slightly rough contact surface for improved gripping and the second roller on manual hair anchor 20 is an idler roller 26 with a smooth contact surface. Idler roller 26 is mounted on and freely rotates on spring loaded shield/guide 28, with the idler roller 26 being pushed against the drive roller 24 from the force being exerted by the spring loaded shield/guide 28 on idler roller 26. Shield/guide 28 also prevents user hair from entering the roller drive system and helps guide the skin pulling flap 10 into the roller drive system on the first end of manual hair anchor 20 and then guides the skin pulling flap 10 to exit the roller drive system back out over the second end of manual hair anchor 20. The user attaches the second end of skin pulling flap 10 to manual hair anchor 20 by lifting spring loaded shield/guide 28 by a handle on shield/guide 28 that moves idler roller 26 away from drive roller 24, creating an opening that the second end of skin pulling flap 10 is routed through by the user. The user then releases the handle on shield/guide 28 allowing idler roller 26 to close and press against the second end of skin pulling flap 10 and pinching the second end of skin pulling flap 10 between idler roller 26 and drive roller 24 with the roller drive system now engaged. Drive roller 24 and idler roller 26 when engaged are nearly inline parallel to the direction the pull/tension force is being applied to the second end of skin pulling flap 10 thus allowing for the roller drive system in manual hair anchor 20 to be very thin and having the least intrusive height required for manual hair anchor 20. As a safety measure if the pull/tension force on skin pulling flap 10 becomes excessive, spring loaded shield/guide 28 will raise up with idler roller 26 pulling away from drive roller 24 and thus losing traction and causing slippage of the second end of skin pulling flap 10 against drive roller 24 to limit any further increase in the pull/tension force being exerted on skin pulling flap 10. The second end of skin pulling flap 10 is pulled by the user, moving between drive roller 24 and idler roller 26 on manual hair anchor 20 and when the skin pulling flap 10 is released by the user, the drive roller 24 on manual hair anchor 20 locks stationary by a ratchet mechanism geared to drive roller 24, thereby reliably and securely holding skin pulling flap 10 fixed and locked between the rollers on manual hair anchor 20 and exerting the desired pull/tension force on the user's skin through skin pulling flap 10 to the attachment point where skin pulling flap 10 adheres to the user's skin, such that the user achieves the desired skin alteration. Skin pulling flap 10 is inserted and pinched into the roller drive system of manual hair anchor 20 anywhere along the length of the second end of skin pulling flap 10 and the user can manually advance and latch the skin pulling flap 10 in small linear increments, allowing for a micro-fine adjustment resolution of the pull/tension force on the user's skin. The drive roller 24 on manual hair anchor 20 winds a torsion spring as skin pulling flap 10 is pulled through manual hair anchor 20 as the drive roller 24 rotates. The pull/tension force on the user's skin is released by pressing flap release button 36 located on the side of manual hair anchor 20, that releases the ratchet mechanism for drive roller 24 on manual hair anchor 20 and the wound torsion spring unwinds and rotates the drive roller 24, thereby driving the second end of skin pulling flap 10 out of manual hair anchor 20 and releasing the pull/tension force on the user's skin while moving skin pulling flap 10 into a released position. Alternately the pull/tension force on the user's skin is released by lifting the handle on shield/guide 28 that moves idler roller 26 away from drive roller 24, thereby releasing the gripping by the rollers on the second end of skin pulling flap 10 and also automatically releases the ratchet mechanism for drive roller 24 on manual hair anchor 20 and the wound torsion spring unwinds and rotates the drive roller 24, allowing the second end of skin pulling flap 10 to freely exit the roller drive system on the second end of manual hair anchor 20. An alternate design for the second end of manual hair anchor 20 is shown in FIG. 9 depicting manual hair anchor 50 where the roller drive system is removed from manual hair anchor 20 and replaced with a friction gripping system in the second end of manual hair anchor 50 consisting of cylindrical depression 52 in manual hair anchor 50 that has an outer rough contact surface 56 and the curved contact surface of spring loaded shield/guide 54 has an outer rough contact surface 56 such that when spring loaded shield/guide 54 is closed and engaged, the second end of skin pulling flap 10 is pressed into cylindrical depression 52 and pinched between the rough contact surface 56 of cylindrical depression 52 and the rough contact surface 56 of the curved contact surface of spring loaded shield/guide 54, such that skin pulling flap 10 is securely held fixed in position and thus maintaining the desired pull/tension force on the user's skin through skin pulling flap 10. Shield/guide 54 also prevents user hair from entering the friction gripping system and helps guide skin pulling flap 10 into the friction gripping system on first end of manual hair anchor 50 and then guides skin pulling flap 10 to exit the friction gripping system back out over second end of manual hair anchor 50. The user attaches the second end of skin pulling flap 10 to manual hair anchor 50 by lifting spring loaded shield/guide 54 by a handle on shield/guide 54 that moves the curved contact surface of shield/guide 54 away from cylindrical depression 52 on manual hair anchor 50, creating an opening that second end of skin pulling flap 10 is routed through by the user. The user then releases the handle on shield/guide 54 allowing the curved contact surface on spring loaded shield/guide 54 to close and press against the second end of skin pulling flap 10 and pinching the second end of skin pulling flap 10 between the curved contact surface on shield/guide 54 and the cylindrical depression 52 on manual hair anchor 50 with the friction gripping system now engaged. Shield/guide 54 when engaged is very low profile thus allowing manual hair anchor 50 to be very thin and having the least intrusive height required for manual hair anchor 50. As a safety measure if the pull/tension force on skin pulling flap 10 becomes excessive, spring loaded shield/guide 54 will raise up with the curved contact surface on shield/guide 54 pulling away from the cylindrical depression 52 on manual hair anchor 50 and thus losing traction and causing slippage of second end of skin pulling flap 10 against friction surfaces 56 to limit any further increase in the pull/tension force being exerted on skin pulling flap 10. The second end of skin pulling flap 10 is pulled by the user, moving between the curved contact surface of shield/guide 54 and cylindrical depression 52 on manual hair anchor 50 and when skin pulling flap 10 is released by the user, the curved contact surface on spring loaded shield/guide 54 presses skin pulling flap 10 back into the cylindrical depression 52 on manual hair anchor 50 grasping and holding stationary the second end of skin pulling flap 10, thereby reliably and securely holding skin pulling flap 10 fixed stationary and exerting the desired pull/tension force on the user's skin through skin pulling flap 10 to the attachment point where skin pulling flap 10 adheres to the user's skin, such that the user achieves the desired skin alteration. Skin pulling flap 10 is inserted and pinched into the friction gripping system of manual hair anchor 50 anywhere along the length of the second end of skin pulling flap 10 and the user can manually advance and latch skin pulling flap 10 in small linear increments, allowing for a micro-fine adjustment resolution of the pull/tension force on the user's skin. The pull/tension force on the user's skin is released by pressing flap release button 36 located on the side of manual hair anchor 50, that moves the curved contact surface of shield/guide 54 away from the cylindrical depression 52 on manual hair anchor 50 thereby releasing the grip on skin pulling flap 10 and the pull/tension force on the user's skin. Alternately the pull/tension force on the user's skin is released by lifting the handle on shield/guide 54 that moves the curved contact surface on shield/guide 54 away from cylindrical depression 52 on manual hair anchor 50, thereby releasing the gripping on the second end of skin pulling flap 10, allowing the second end of skin pulling flap 10 to freely exit the friction gripping system of manual hair anchor 50. The second end of remote control hair anchor 22 is an enclosure containing multiple subsystems, as follows: 1) roller drive system consisting of two rollers that the flat surface of the second end of skin pulling flap 10 rolls between; 2) direct current electric motor with reduction gear system to rotate the drive roller 24; 3) programmable electronic microcontroller; 4) RF (radio frequency) electronic transmitter/receiver with antenna; 5) pressure sensor to measure the pull/tension force being exerted on skin pulling flap 10; 6) speed/rotation sensor to measure the rotation and direction motion of drive roller 24; 7) recognition sensor 42 to measure the linear movement of skin pulling flap 10; 8) position switch/sensor to monitor the spring loaded shield/guide position; 9) internal temperature sensor; 10) push button switch 38 that the user presses to initiate actions; 11) audible noise generator; 12) power saving circuitry; and 13) one or more removable and replaceable miniature battery. All subsystems except drive roller 24 and idler roller 26 are enclosed within electromechanical containment area 44 within the second end of remote control hair anchor 22. The first roller on remote control hair anchor 22 is a drive roller 24 with a slightly rough contact surface for improved gripping and the second roller on remote control hair anchor 22 is an idler roller 26 with a smooth contact surface. Idler roller 26 is mounted on and freely rotates on spring loaded shield/guide 28, with the idler roller 26 being pushed against the drive roller 24 from the force being exerted by the spring loaded shield/guide 28 on idler roller 26. Shield/guide 28 also prevents user hair from entering the roller drive system and helps guide the skin pulling flap 10 into the roller drive system on the first end of remote control hair anchor 22 and then guides the skin pulling flap 10 to exit the roller drive system back out over the second end of remote control hair anchor 22. The drive roller 24 on remote control hair anchor 22 is driven by a direct current miniature electric motor with a miniature reduction gear system to generate the required torque to rotate the drive roller 24 and to turn the drive roller 24 at the correct rotational speed. The miniature reduction gear system is typically a planetary gear system with approximately a 700:1 ratio output rotational speed. The electric motor can rotate the drive roller 24 in either a clockwise or counterclockwise direction as directed by the microcontroller. The rotational speed of the electric motor and therefore the rotational speed of the drive roller 24 is variable and controlled by the microcontroller using pulse width modulation. The user attaches the second end of skin pulling flap 10 to remote control hair anchor 22 by lifting spring loaded shield/guide 28 by a handle on shield/guide 28 that moves idler roller 26 away from drive roller 24, creating an opening that the second end of skin pulling flap 10 is routed through by the user. The user then releases the handle on shield/guide 28 allowing idler roller 26 to close and press against the second end of skin pulling flap 10 and pinching the second end of skin pulling flap 10 between idler roller 26 and drive roller 24 with the roller drive system now engaged. Drive roller 24 and idler roller 26 when engaged are nearly inline parallel to the direction the pull/tension force is being applied to the second end of skin pulling flap 10 thus allowing for the roller drive system in remote control hair anchor 22 to be very thin and having the least intrusive height required for remote control hair anchor 22. As a safety measure, spring loaded shield/guide 28 will raise up with idler roller 26 pulling away from drive roller 24 and thus losing traction and causing slippage of the second end of skin pulling flap 10 against drive roller 24 if the pull/tension force on the skin pulling flap 10 becomes excessive. The second end of skin pulling flap 10 is driven by the drive roller 24 with idler roller 26 pressing against it, being rotated by the electric motor in a clockwise direction which draws and pulls the second end of skin pulling flap 10 into the roller drive system and then back out over the surface of the second end of remote control hair anchor 22, thereby exerting the desired pull/tension force on the user's skin through skin pulling flap 10 to the attachment point where skin pulling flap 10 adheres to the user's skin, such that the user achieves the desired skin alteration. Skin pulling flap 10 is inserted and pinched into the roller drive system of remote control hair anchor 22 anywhere along the length of the second end of skin pulling flap 10 and the electric motor can advance and latch skin pulling flap 10 in small linear increments, allowing for a micro-fine adjustment resolution of the pull/tension force on the user's skin. Shield/guide 28 guides and controls the movement of the second end of skin pulling flap 10 as it exits the roller drive system and as skin pulling flap 10 moves out over the outer surface of the second end of remote control hair anchor 22 and shield/guide 28 keeps skin pulling flap 10 sliding in close proximity to recognition sensor 42 that detects the linear motion of skin pulling flap 10. The electric motor when stopped continues to grip the second end of skin pulling flap 10 and since the reduction ratio in the reduction gear system is very high, the drive roller 24 remains stopped in a stationary position, thereby reliably and securely holding skin pulling flap 10 fixed and locked between the rollers on remote control hair anchor 22 and thus maintaining the desired pull/tension force on the user's skin. Reversing the electric motor into a counter clockwise rotation pushes the second end of skin pulling flap 10 back out of the roller drive system and thereby decreasing the pull/tension force on skin pulling flap 10 and the user's skin at the attachment point. The user remotely controls the electric motor within remote control hair anchor 22 and thus the motion of skin pulling flap 10, using an RF (radio frequency) communication/frequency enabled device with security encryption (like Bluetooth) such as a mobile phone 60 that is running an application for the present invention or alternately a dedicated remote control device 62, to perform one any of the following actions: 1) increase the pull/tension force on skin pulling flap 10 by activating the electric motor and rotating drive roller 24 clockwise; 2) decrease the pull/tension force on skin pulling flap 10 by activating the electric motor and rotating drive roller 24 counterclockwise; or 3) deactivate electric motor to lock stationary skin pulling flap 10 at the current position. The first end of remote control hair anchor 22 is hinged to the second end of remote control hair anchor 22 and the first end has an arm extending into the second end of remote control hair anchor 22 that presses on a pressure sensor, that allows the microcontroller to measure the pull/tension force being exerted on skin pulling flap 10, thereby allowing the microcontroller to automatically set, adjust and maintain the force being exerted on skin pulling flap 10 at a preset or stored level and as a safety measure to prevent too much pull/tension force from being applied to skin pulling flap 10. A second recognition sensor 42 located on the outside of the second end of remote control hair anchor 22, measures the linear motion of skin pulling flap 10 by detecting a series of bar code markings 14 imprinted or molded onto the skin pulling flap 10 surface as skin pulling flap 10 slides over recognition sensor 42, to enable the microcontroller to measure the linear motion, direction and end points of the second end of skin pulling flap 10. A third sensor contained within the second end of remote control hair anchor 22, allows the microcontroller to measure the rotation speed and direction of drive roller 24. A fourth switch/sensor contained within the second end of remote control hair anchor 22, allows the microcontroller to detect the position of the spring loaded shield/guide 28. A fifth sensor contained within the second end of remote control hair anchor 22, allows the microcontroller to measure the internal temperature of the electronics within the second end of remote control hair anchor 22 as a safety measure. The microcontroller communicates with the user's mobile communication device or dedicated remote control device 62 through an RF (radio frequency) electronic transmitter/receiver with an embedded internal chip antenna contained in remote control hair anchor 22, within typically the 2.4 ghz frequency range. An audible noise generator contained within remote control hair anchor 22, allows the microcontroller to audibly signal the user when prompted to do so by a user's action. A pressure sensitive push button switch 38 is located on the outside of the remote control hair anchor 22 that allows the user when pressed, to interact, signal and train the microcontroller within remote control hair anchor 22 to synchronize with the user's mobile communication device or dedicated remote control device 62. Pressing flap release button 36 located on the side of remote control hair anchor 22 mechanically disengages the drive roller 24 by releasing the pressure holding the idler roller 26 against the drive roller 24 if quick disengagement and release of the pull/tension force being exerted on skin pulling flap 10 is desired by the user. One or more batteries are contained within the second end of remote control hair anchor 22 that power the electric motor and electronics. The batteries are removable and replaceable through a latching battery access door 40 at the end of the second end of remote control hair anchor 22. The microcontroller has power saving circuitry that can measure the remaining energy in the battery and takes measures to minimize power usage to preserve the battery life. The user interacts with remote control hair anchor 22, as follows: 1) pressing the pressure sensitive push button switch 38 located on the outside of second end of remote control hair anchor 22 by using a specific series of sequential switch closures while prompted by the audible sound emitted by remote control hair anchor 22; or 2) remote control using an RF (radio frequency) communication/frequency enabled wireless mobile communication device with security encryption (like Bluetooth) such as a mobile phone 60 running an application for the electro-mechanical skin pulling device permits the user to adjust the pull/tension force being exerted on the user's skin at a specified location on the user's face/neck using buttons on the mobile communication device's screen while simultaneously watching the alteration actually occurring on their face/neck overlaid on the mobile communication device's display screen as if looking into a mirror, without the user ever having to even touch the user's hair or face and communicating with and controlling up to 16 skin pulling flap 10/remote control hair anchor 22 pairs simultaneously on the user; or 3) remote control using an RF (radio frequency) communication/frequency enabled dedicated remote control device 62 permits the user to adjust the pull/tension force being exerted on the user's skin at a specified location on the user's face/neck without the user ever having to even touch the user's hair or face and communicating with and controlling up to 16 skin pulling flap 10/remote control hair anchor 22 pairs simultaneously on the user. Therefore with the user's mobile communication device, the user can adjust the skin pull/tension force being exerted on skin pulling flaps 10 while simultaneously watching the alteration actually occurring on their face/neck on the mobile communication device's display screen. Dedicated remote control device 62 can be embedded into other complimentary cosmetic related devices, both fixed, portable and foldable, such as a cosmetic makeup case, cosmetic tote bag or cosmetic compact makeup case 64 that contains dedicated remote control device 62 and any of the following example features: 1) mirror for viewing the user's face, neck and hair; 2) viewing lighting that lights-up the user's face, neck and hair; 3) cosmetic makeup; 4) cosmetic tools like brushes/applicators; 5) other cosmetic/hair/personal items; and 6) spare electro-mechanical skin pulling device apparatus items; thus permitting the user to adjust the skin pull/tension force being applied to their face and neck while simultaneously watching the adjustment actually occurring on their face and neck in the mirror contained in their cosmetic case device. Each remote control hair anchor 22 is synchronized with the user's mobile communication device or dedicated remote control device 62 by the user pressing the external pressure sensitive switch 38 on remote control hair anchor 22 to transmit a registration code for the location of remote control hair anchor 22 on the user's head/neck and the communication ID of that particular remote control hair anchor 22. The microcontroller notifies the user of issues like low battery or other diagnostic monitoring by transmitting the status to the user's mobile communication device or dedicated remote control device 62 to alert the user of the issue. Typically this present electro-mechanical skin pulling device is used in pairs with the second electro-mechanical skin pulling device located on the side directly opposite of the first electro-mechanical skin pulling device on the user's head or neck. An example location for the electro-mechanical skin pulling device is with skin pulling flap 10 attached and adhering to the user's bare skin just outside of the hairline at the user's right temple with the second end of the skin pulling flap 10 pulled back to a manual hair anchor 20 or remote control hair anchor 22 that is fixed to the user's hair next to the scalp, with manual hair anchor 20 or remote control hair anchor 22 being located just above the user's right ear; then a second electro-mechanical skin pulling device is attached at the user's left temple area and above the user's left ear, allowing the user to pull/alter the skin in the general eye and upper face areas on both sides of the face in balanced unison. The first end of manual hair anchor 20 and remote control hair anchor 22 that functions to grasp onto the user's hair and serve as a fixed anchor point, can be separated and incorporated into other applications and anchoring devices such as clips, clasps, barrettes, head bands, wigs, toupees or other hair attachment/anchoring devices. Both the second end of manual hair anchor 20 and remote control hair anchor 22 that functions to grasp the second end of skin pulling flap 10 and apply more or less pull/tension force to skin pulling flap 10 or to maintain the current pull/tension force on skin pulling flap 10, can be separated and incorporated into other skin altering and anchoring devices such as clips, clasps, barrettes, head bands, wigs, toupees or other hair attachment/anchoring devices. The first end mechanism of manual hair anchor 20 and remote control hair anchor 22 and the second end mechanism of either manual hair anchor 20 and remote control hair anchor 22, can be separated and multiples of either mechanism or in combination, can be incorporated onto one device such as a head band that the user can wear in or over the user's hair and connect to one or more skin pulling flaps 10 simultaneously.

In further detail, still referring to the invention of FIG. 1 to FIG. 10, the first end of skin pulling flap 10 can be any shape, but is usually shaped to follow and match the user's hairline at the point of application and having at least 0.20 square inches of skin connection area for the glue or a double-sided glue strip to be applied to. This allows skin pulling flap 10 to be small enough to conceal along the hairline and yet large enough to adequately and securely attach to the skin. Overall skin pulling flap 10 is generally about 2.0 inches to 3.0 inches long and 1.0 inches wide on the first end and 0.30 inches wide on the second end with a 0.070 inches thickness overall. Skin pulling flap 10 is a single piece of material that is partially or entirely injected with hair or embedded with hair or punched with hair or with hand sewn hair protruding out from the skin pulling flap 10 and a flat smooth surface on the opposite side of the skin pulling flap 10 material; the attached hair can have any practical length although generally the hair is about 1 inch long and tapers to a shorter length closer to selected edges to simulate the user's actual hairline. The manual hair anchor 20 is generally rectangular in shape with a length of 1.25 inches to 1.5 inches, with a width of 0.75 inches and a thickness of 0.20 inches to 0.25 inches. The alternate design manual hair anchor 50 is generally rectangular in shape with a length of 1.25 inches to 1.5 inches, with a width of 0.75 inches and a thickness of 0.12 inches to 0.15 inches. The remote control hair anchor 22 is generally rectangular in shape with a length of 1.75 inches to 2.0 inches, with a width of 0.75 inches and a thickness of 0.20 inches to 0.30 inches. The modified fork-like prongs on the first end of manual hair anchor 20, manual hair anchor 50 and remote control hair anchor 22 are generally 0.75 inches to 1.0 inches long and taper in width from 0.10 inches to 0.15 inches with a thickness of 0.125 inches on the outer prongs and are generally 0.75 inches to 1.0 inches long and taper in width from 0.10 inches to 0.35 inches with a thickness of 0.125 inches on the inner prong(s).

The construction details of the invention as shown in FIG. 1 to FIG. 10, are that the electro-mechanical skin pulling device has skin pulling flap 10 that is an elongated single piece of material formed from a soft pliable flat material that is partially or entirely injected with hair or embedded with hair or punched with hair or with hand sewn hair protruding out from the skin pulling flap 10 material on one side and a flat smooth surface on the opposite side of the skin pulling flap 10 material. Hair projecting from the soft pliable flat material is human hair or animal fur hair or artificial hair or artificial fur hair and is attached and angled so the hair naturally lays in the same direction and orientation as the user's own natural hair and the hair can be colored to match the user's hair color of choice. The soft pliable flat material that skin pulling flap 10 is manufactured from is formed using either a molding process or by a cutting process, from polyurethane or latex or nylon or polyester or polymer or silicone or rubber or sponge or plastic or like formulation that is manufactured as a mesh internal structure that is coated with a surface formulation that will grip the user's skin and provide sufficient friction for the roller drive system within manual hair anchor 20 and remote control hair anchor 22 to grasp and hold. The mesh internal structure acts as a super structure to evenly distribute pull/tension force being applied across the width and along the length of skin pulling flap 10. The soft pliable flat material that skin pulling flap 10 is made from can be any color, but preferably a color close to the user's own skin color or is nearly clear so as to be transparent or semitransparent. The edges of the skin pulling flap 10 material are sealed to minimize fraying of the material with use. The thickness of the skin pulling flap 10 material tapers from the normal thickness to a much thinner thickness along selected edges of skin pulling flap 10 to provide a realistic transition appearance from skin pulling flap 10 material to bare skin where the skin pulling flap 10 is attached to the user's skin. Furthermore skin pulling flap 10 is reusable and glue designed for attachment to skin, peels off and is fully removable with a cleaning agent to allow a new glue or double-sided glue strip application to be applied to skin pulling flap 10. The tip of the second end of skin pulling flap 10 has an elevated edge 12 formed during molding process of manufacturing skin pulling flap 10 or by application of an adhesive/sealant bead to the pliable soft flat material that skin pulling flap 10 is manufactured from. Manual hair anchor 20 and remote control hair anchor 22 are formed from metal, plastic, polymer, nylon, rubber, carbon fiber, or other like material colored to match the user's natural skin tone or colored to match the user's hair color of choice. Manual hair anchor 20 and remote control hair anchor 22 are formed with a slightly curved flat shape along the length to follow the curvature of the user's head, with multiple modified fork-like prongs in a row along the first end, with the distance between adjoining fork-like prongs narrowing as the prongs get closer to the second end of manual hair anchor 20 and remote control hair anchor 22. The second end of manual hair anchor 20 is an enclosure containing the roller drive system. The second end of remote control hair anchor 22 is an enclosure containing the roller drive system, electric motor with reduction gear system, electronics, sensors and battery.

The advantages of the present invention include, without limitation, that the remote control version of the present invention permits the user to adjust the pull/tension force at a specified location on the user's skin using buttons on their mobile communication device such as a mobile phone 60 while simultaneously watching the alteration actually occurring on their face/neck overlaid on the mobile communication device's display screen as if looking into a mirror, or using a dedicated remote control device 62 alone or contained within for example a cosmetic compact makeup case 64 device with mirror, without the user having ever to even touch the user's hair or face. The remote control version of the present invention can measure the pull/tension force being exerted on a skin pulling flap 10 and can automatically set the pull/tension force being exerted on the skin pulling flap 10 to a preset level when the electro-mechanical skin pulling device is first put on by the user and can adjust/maintain a preset level of pull/tension force on skin pulling flap 10 while the user is wearing the electro-mechanical skin pulling device. The electro-mechanical skin pulling device has a simple two-piece design consisting of skin pulling flap 10 as the first element and manual hair anchor 20 or remote control hair anchor 22 as the second element. Skin pulling flap 10 is easily and securely fixed in place by adhering to the user's skin at the first end of skin pulling flap 10 using glue or double-sided glue strip. The second end of skin pulling flap 10 is connected to and then drawn into the roller drive system of manual hair anchor 20 or remote control hair anchor 22 to exert the desired pull/tension force on skin pulling flap 10. Manual hair anchor 20 or remote control hair anchor 22 is held securely fixed in place by locking onto the user's hair close to the scalp, thus preventing the present electro-mechanical skin pulling device from shifting vertically or horizontally during activities by the user and thus maintaining a consistent pull/tension force on skin pulling flap 10 attached to the user's skin. The present electro-mechanical skin pulling device connects directly from the skin attachment point on the first end of skin pulling flap 10 directly to the manual hair anchor 20 or remote control hair anchor 22 as the final end anchoring point in a short distance, typically 2.0 inches to 3.5 inches, using a single elongated piece of material. The present electro-mechanical skin pulling device does not use any type of band(s) placed around the head to act as a counter force, as used in Spellerberg and DeAngelis patents cited previously. The first end of skin pulling flap 10 is uniquely shaped for different areas of the user's face and neck to accomplish multiple functions, those functions being: 1) shape of the first end of skin pulling flap 10 has sufficient adhesion area to achieve a secure bond to the user's skin capable of remaining intact with the pull/tension force being exerted on the skin pulling flap 10; 2) shape of first end of the skin pulling flap 10 is wide enough along the hairline to pull the entire breadth of skin necessary to achieve the alteration desired on that part of the user's face or neck; 3) shape of first end of the skin pulling flap 10 structurally distributes the pulling force being applied to the skin pulling flap 10 evenly across the entire breadth of skin necessary along the hairline to achieve the alteration desired on that part of the user's face or neck; 4) shape of first end of the skin pulling flap 10 follows the contour of the hairline on that part of the user's face or neck to disguise and blend-in the first end of the skin pulling flap 10; and 5) shape of first end of the skin pulling flap 10 has sufficient area to fill-in and extend and refill hair along the hairline onto bare skin areas where the user desires additional hair and/or where the hair line has been pulled back by the pull/tension force being exerted on the skin attachment point on the user's skin by the skin pulling flap 10 and the user desires to fill-in and extend the hairline to recreate the original hairline, thereby providing a hairline extension or a secondary hairline of realistic looking hair. Manual hair anchor 20 or remote control hair anchor 22 is swept into the user's hair next to the scalp filling the channels between prongs and then the user presses hair lock button 32 located on the side of manual hair anchor 20 or on the side of remote control hair anchor 22, that then mechanically moves the internal sliding actuator bar. The movement of the internal sliding actuator bar then presses out and slides closer the spring loaded blocking protrusion/gate 30 in each channel which closes off a portion of the channel between fork-like prongs, thereby grasping the user's hair and fixing the manual hair anchor 20 or remote control hair anchor 22 in place. The pull/tension force being exerted on manual hair anchor 20 or remote control hair anchor 22 is then comfortably distributed across many multiple hair shafts at their base close to the scalp and perpendicular to the direction that the hair shaft comes out of the user's scalp; whereas the DeAngelis patent cited previously pulls the hair outwardly parallel to the hair shaft thus causing the user discomfort and potential hair breakage and hair loss from the hair being pulled out of the scalp. Furthermore the DeAngelis patent cited previously does not pull on the skin directly but instead pulls on the user's hair located near to the hairline using two metal snap clips, one on each side of the head that then pulls the scalp and then as an indirect secondary effect only partially pulls the skin outside the hairline. Manual hair anchor 20 and remote control hair anchor 22 have a simple quick connect/quick release reusable fastener system using the roller drive system to connect and release the skin pulling flap 10 to manual hair anchor 20 or remote control hair anchor 22. Manual hair anchor 20 and remote control hair anchor 22 have a micro-fine adjustment resolution of the pull/tension force on skin pulling flap 10 either manually by the user pulling the skin pulling flap 10 further through the rollers in the manual hair anchor 20 or by remote control to activate the electric motor driven rollers in the remote control hair anchor 22. Drive roller 24 and idler roller 26 in the roller drive system when engaged, are nearly inline parallel to the direction that the pull/tension force is being applied to the second end of skin pulling flap 10 thus allowing for the roller drive system in manual hair anchor 20 and remote control hair anchor 22 to be very thin and having the least intrusive height required for manual hair anchor 20 and remote control hair anchor 22. The Spellerberg and DeAngelis patents cited previously both rely on a band or other like elongated member to exert the pull force that is routed from one side of the user's head to the opposite side of the head to act as a counterforce mechanism, such that the pull force being exerted is primarily in a horizontal direction only with little direction adjustment. The electro-mechanical skin pulling device of the present invention having no need for bands required around the head acting as a counter force, provides significant advantages, as follows: 1) the present electro-mechanical skin pulling device can be attached on bare skin anywhere along the hairline on the face and neck, that is most anywhere around the user's head/neck to alter facial features including forehead, eyes, eyebrows, crow's feet wrinkles around the eyes, nasolabial folds, cheek wrinkles; neck/throat features such as turkey neck, sagging jaw, crepey skin; and specific user features such as elongation of the eyes; 2) pull/tension force can be applied in both a vertical and horizontal direction of the user's choice, by placing manual hair anchor 20 or remote control hair anchor 22 anywhere in the user's hair within a 170 degree arc surrounding the point that skin pulling flap 10 is attached to the user's skin; and 3) the present electro-mechanical skin pulling device has a much smaller size making it easier to hide and disguise by the user and can be used with shorter user hairstyles with user hair as short as two inches in length. The present invention can be used in a multitude of applications including but not limited to non-surgical external face and/or neck/throat lift to minimize wrinkles and sagging and/or a measuring/positioning fitting tool for a surgical face lift and/or a skin pulling/tensioning tool for post-operative surgical recovery/healing and/or for facial pulling/tensioning for paralysis and/or for general cosmetic facial alterations such as extending the appearance of the eyes and face shaping and/or for correction of less desirable features resulting from an accident or birth deformity.

In broad embodiment, the present invention allows skin to be pulled and held in place in a convenient, comfortable, reliable and safe manner that is easily adjusted and easily hidden and disguised. Furthermore by using multiple electro-mechanical skin pulling devices at the same time, permits different skin areas on the user to be simultaneously pulled allowing the user to achieve the complete alteration so desired. Furthermore the present invention integrates an optional wireless remote control adjustment/monitoring system using either a mobile communication device like a mobile phone 60 running an application for the present invention or a dedicated remote control device 62 to adjust and maintain the desired skin alteration.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. An electro-mechanical skin pulling device apparatus with two members, to be worn by a user comprising:

a) a skin pulling flap member (10) having an elongated shape and having a first end and a second end; and b) a manual hair anchor member (20) having a rectangular shape and having a first end and a second end; or c) a remote control hair anchor member (22) having a rectangular shape and having a first end and a second end; and said first end of said skin pulling flap member (10) is configured to be attached to the user's bare skin along the hairline using glue or a double-sided glue strip; and said second end of said skin pulling flap member (10) has an elongated flat shape that connects to and is pulled by said manual hair anchor member (20) or said remote control hair anchor member (22); and said first end of said manual hair anchor member (20) and said first end of said remote control hair anchor member (22) are shaped like modified prongs on a fork with an internal sliding actuator bar that when activated by the user, grasps the user's hair and secures said manual hair anchor member (20) or said remote control hair anchor member (22) to the user's head close to the scalp; and said second end of said manual hair anchor member (20) and said second end of said remote control hair anchor member (22) has a roller drive system that pulls and locks said second end of said skin pulling flap member (10) between two rollers; and said manual hair anchor member (20) allows the user to manually pull said second end of said skin pulling flap member (10) through the roller drive system within said manual hair anchor member (20) to apply a pull/tension force on the skin attached to said first end of said skin pulling flap member (10) and then lock stationary said second end of said skin pulling flap member (10) when released by the user; and said remote control hair anchor member (22) has an electric motor geared to the roller drive system controlled by microcontroller electronics to pull said second end of said skin pulling flap member (10) through the roller drive system within said remote control hair anchor member (22) to apply a pull/tension force on the skin attached to said first end of said skin pulling flap member (10) and then lock stationary said second end of said skin pulling flap member (10) when the electric motor is stopped stationary; and said remote control hair anchor member (22) is remotely controlled wirelessly by the user using either a mobile communication device like a mobile phone (60) that is running mobile application software for the present invention or alternately controlled by a dedicated remote control device (62).

2. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side and a flat smooth surface on the opposite side of the soft pliable flat material; the soft pliable flat material that said skin pulling flap member (10) is manufactured from is formed using either a molding process or cutting process or like process, from polyurethane or latex or nylon or polyester or polymer or silicone or rubber or sponge or plastic or like formulation that is manufactured as a mesh internal structure that is coated with a surface formulation that will grip the user's skin and provide sufficient friction for the roller drive system within said manual hair anchor member (20) and said remote control hair anchor member (22) to grasp and hold; the mesh internal structure of the soft pliable flat material that said skin pulling flap member (10) is manufactured from, acts as a super structure to evenly distribute the pull/tension force being applied across the width and along the length of said skin pulling flap member (10); with the attached hair being human hair or animal fur hair or artificial hair or artificial fur hair.

3. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; with the soft pliable flat material being colored to match the user's natural skin tone or transparent or semi-transparent to blend in with the user's natural skin color; with the attached hair being colored to match the user's hair color of choice.

4. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; with the attached hair having any practical length and serves to disguise and hide said skin pulling flap member (10) and said manual hair anchor member (20) or said remote control hair anchor member (22) from being seen and/or to fill in and provide longer lengths of simulated hair to compliment the user's own hair.

5. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; with the attached hair having any practical length and serves to fill-in and extend hair along the hairline onto bare skin areas where the user desires additional hair and/or where the hairline has been pulled back by the pull/tension force being exerted on the skin by said skin pulling flap member (10) and the user desires to fill-in and extend the hairline to recreate the original hairline; thereby providing a hairline extension or a secondary hairline of realistic looking hair.

6. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; with the hair attached and angled to naturally lay in the same direction and orientation as the user's own natural hair.

7. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; with the attached hair along selected edges of said skin pulling flap member (10) is trimmed to have the same realistic appearance and characteristics as does the hair along the user's own natural hairline; with such characteristics as having finer hair, thinner hair and more baby-like hair.

8. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; the thickness of the soft pliable flat material tapers from the normal thickness to a much thinner thickness along selected edges of said skin pulling flap member (10) to provide a realistic transition appearance from the soft pliable flat material to bare skin where said skin pulling flap member (10) is attached to the user's skin.

9. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; said skin pulling flap member (10) made from soft pliable flat material is reusable by detaching said first end of said skin pulling flap member (10) from the attachment point on the user's bare skin, then cleaning/sanitizing said skin pulling flap member (10) with a cleaning agent and then reattaching said first end of said skin pulling flap member (10) to the user's bare skin.

10. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side, with said skin pulling flap member (10) having multiple functions, those functions being: 1) shape of said first end of said skin pulling flap member (10) has sufficient adhesion area to achieve a secure bond to the user's skin capable of remaining intact with the pull/tension force being exerted on said skin pulling flap member (10); 2) shape of said first end of said skin pulling flap member (10) is wide enough along the hairline to pull the entire breadth of skin necessary to achieve the alteration desired on that part of the user's face or neck; 3) shape of said first end of said skin pulling flap member (10) structurally distributes the pulling force being applied to said skin pulling flap member (10) evenly across the entire breadth of skin necessary along the hairline to achieve the alteration desired on that part of the user's face or neck; 4) shape of said first end of said skin pulling flap member (10) matches and follows the user's actual hairline so to blend in and look most natural on the user; 5) said skin pulling flap member (10) transmits the pulling/tension force point to point directly between the skin attachment point on the user's skin to said manual hair anchor member (20) or said remote control hair anchor member (22) as the final end anchoring point; 6) the attached hair on said skin pulling flap member (10) serves to disguise and hide said skin pulling flap member (10) and said manual hair anchor member (20) or said remote control hair anchor member (22) from being seen and/or to fill in and provide longer lengths of simulated hair to compliment the user's own hair; and 7) the attached hair on said skin pulling flap member (10) serves to fill-in and extend hair along the hairline onto bare skin areas where the user desires additional hair and/or where the hairline has been pulled back by the pull/tension force being exerted on the skin by said skin pulling flap member (10) and the user desires to fill-in and extend the hairline to recreate the original hairline.

11. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side; with the tip of said second end of said skin pulling flap member (10) has an elevated edge (12) that allows for easy grasping of said skin pulling flap member (10) by the user and so the user can more easily find the actual end of said skin pulling flap member (10) by touch.

12. An electro-mechanical skin pulling device apparatus as recited in claim 1, wherein said skin pulling flap member (10) is a single piece of material formed from a soft pliable flat material that is partially or entirely injected with hair or embedded with hair or punched with hair or with hand sewn hair protruding out from the soft pliable flat material on one side and a flat smooth surface on the opposite side of the soft pliable flat material; with a series of bar code markings (14) imprinted or molded onto said second end of said skin pulling flap member (10) smooth surface, that allows recognition sensor (42) on said second end of said remote control hair anchor member (22) to measure the linear motion, direction and end points of said skin pulling flap member (10) as said skin pulling flap member (10) slides over recognition sensor (42).

13. An electro-mechanical skin pulling device apparatus as recited in claim 1, wherein said manual hair anchor member (20) and said remote control hair anchor member (22) is formed from metal, plastic, polymer, nylon, rubber, carbon fiber or other like material colored to match the user's natural skin tone or colored to match the user's hair color of choice; said manual hair anchor member (20) and said remote control hair anchor member (22) is formed with a slightly curved flat shape along the length to follow the curvature of the user's head; said first end of said manual hair anchor member (20) and said first end of said remote control hair anchor member (22) has multiple modified fork-like prongs with user activated protrusions/gates (30) whose purpose is to comfortably grasp onto the user's hair and serve as a fixed anchor point on the user's head; said second end of said manual hair anchor member (20) is an enclosure containing a roller drive system; said second end of said remote control hair anchor member (22) is an enclosure containing a roller drive system, electric motor with reduction gear system, electronics, sensors and battery.

14. An electro-mechanical skin pulling device apparatus as recited in claim 1, wherein said first end of said manual hair anchor member (20) and said first end of said remote control hair anchor member (22) is shaped like modified prongs on a fork with typically three prongs; the outer prongs are typical of those on a traditional fork being narrow at the outer end and becoming slightly larger as they connect to the main body of said manual hair anchor member (20) or said remote control hair anchor member (22) and are of a solid material construction; the center prong is narrow at the end and widens significantly where the center prong is connected to the main body of said manual hair anchor member (20) and said remote control hair anchor member (22) and has a hollowed cavity contained within it; this modified fork-like prongs configuration on said first end of said manual hair anchor member (20) and on said first end said remote control hair anchor member (22) when swept into the user's hair next to the scalp, directs the user's hair into the narrower part of the two channels between prongs on the outer sides of said manual hair anchor member (20) and said remote control hair anchor member (22), and thus leaves the center portion of the center prong free of user hair at the location where said skin pulling flap member (10) slides over, and thus does not drag or snag user hair into the roller drive system on said second end of said manual hair anchor member (20) and on said second end of said remote control hair anchor member (22); said manual hair anchor member (20) and said remote control hair anchor member (22) when placed into the user's hair is oriented in line with the direction the user desires said skin pulling flap member (10) to be pulled, with the modified fork-like prongs on said first end of said manual hair anchor member (20) and on said first end of said remote control hair anchor member (22) pointing towards the point at which said skin pulling flap member (10) is attached to the user's skin; the center prong has two flap guide posts (34) that rise above the center prong surface at the edges that serve as guides to direct said second end of said skin pulling flap member (10) between the flap guide posts (34) as said skin pulling flap member (10) moves in and out of the roller drive system on said second end of said manual hair anchor member (20) and on said second end of said remote control hair anchor member (22); contained within said first end of said manual hair anchor member (20) and said first end of said remote control hair anchor member (22) is an internal sliding actuator bar that when activated by the user, closes off a portion of the channel between the fork-like prongs, by pushing two spring loaded blocking protrusion/gates (30) contained within the hollow cavity of the center prong through an opening in the side of the center prong, into each channel; said manual hair anchor member (20) and said remote control hair anchor member (22) is held fixed in place on the user's head by sliding said first end of said manual hair anchor member (20)

or said first end of said remote control hair anchor member (22) with the modified fork-like prongs into the user's hair next to the scalp filling the channels between prongs with the user's hair and then the user presses hair lock button (32) located on the side of said manual hair anchor member (20) or on the side of said remote control hair anchor member (22), that then mechanically moves the internal sliding actuator bar; the internal sliding actuator bar then presses out and slides closer the spring loaded blocking protrusion/gates (30) into each channel, closing off the channel and also moving the blocking protrusion/gates (30) closer to said second end of said manual hair anchor member (20) or said second end of said remote control hair anchor member (22), thereby leaving an opening in the channel from the blocking protrusion/gate (30) to the point where the fork-like prongs attach to said second end of said manual hair anchor member (20) or said second end of said remote control hair anchor member (22) where the user's hair is trapped and compressed into the remaining channel opening and grasping the hair so said manual hair anchor member (20) or said remote control hair anchor member (22) is held fixed in place; the blocking protrusion/gate (30) in each channel is retracted when the user presses hair lock button (32) located on the opposite side of said manual hair anchor member (20) or on the opposite side of said remote control hair anchor member (22), that then mechanically moves the internal sliding actuator bar in the opposite direction and thereby retracting the blocking protrusion/gate (30) in each channel; each blocking protrusion/gate (30) is mounted on a metal or a plastic arm that has a flexible spring property which allows the blocking protrusion/gate (30) in each channel to automatically retract as a safety precaution, due to excessive force being exerted on blocking protrusion/gates (30) if said manual hair anchor member (20) or said remote control hair anchor member (22) is pulled out of position by the user or by some other action, without the user first manually retracting the channel blocking protrusion/gates (30).

15. An electro-mechanical skin pulling device apparatus as recited in claim 1, wherein said second end of said manual hair anchor member (20) is an enclosure containing a roller drive system consisting of two rollers that the flat surface of said second end of said skin pulling flap member (10) rolls between; the first roller on said manual hair anchor member (20) is a drive roller (24) with a slightly rough contact surface for improved gripping and the second roller on said manual hair anchor member (20) is an idler roller (26) with a smooth contact surface; idler roller (26) is mounted on and freely rotates on spring loaded shield/guide (28), with the idler roller (26) being pushed against the drive roller (24) from the force being exerted by spring loaded shield/guide (28) on idler roller (26); shield/guide (28) also prevents user hair from entering the roller drive system and helps guide said skin pulling flap member (10) into the roller drive system on said first end of said manual hair anchor member (20) and then guides said skin pulling flap member (10) to exit the roller drive system back out over said second end of said manual hair anchor member (20); the user attaches said second end of said skin pulling flap member (10) to said manual hair anchor member (20) by lifting spring loaded shield/guide (28) by a handle on shield/guide (28) that moves idler roller (26) away from drive roller (24), creating an opening that said second end of said skin pulling flap member (10) is routed through by the user; the user then releases the handle on spring loaded shield/guide (28) allowing idler roller (26) to close and press against said second end of said skin pulling flap member (10) and pinching said second end of said skin pulling flap member (10) between idler roller (26) and drive roller (24) with the roller drive system now engaged; drive roller (24) and idler roller (26) when engaged are nearly inline parallel to the direction the pull/tension force is being applied to said second end of said skin pulling flap member (10) thus allowing for the roller drive system in said manual hair anchor member (20) to be very thin and having the least intrusive height required for said manual hair anchor member (20); as a safety measure if the pull/tension force on said skin pulling flap member (10) becomes excessive, spring loaded shield/guide (28) will raise up with idler roller (26) pulling away from drive roller (24) and thus losing traction and causing slippage of said second end of said skin pulling flap member (10) against drive roller (24) to limit any further increase in the pull/tension force being exerted on said skin pulling flap member (10); said second end of said skin pulling flap member (10) is pulled by the user, moving between drive roller (24) and idler roller (26) on said manual hair anchor member (20) and when said skin pulling flap member (10) is released by the user, the drive roller (24) on said manual hair anchor member (20) locks stationary by a ratchet mechanism geared to drive roller (24), thereby reliably and securely holding said skin pulling flap member (10) fixed and locked between the rollers on said manual hair anchor member (20) and exerting the desired pull/tension force on the user's skin through said skin pulling flap member (10) to the attachment point where said skin pulling flap member (10) adheres to the user's skin, such that the user achieves the desired skin alteration; said skin pulling flap member (10) is inserted and pinched into the roller drive system of said manual hair anchor member (20) anywhere along the length of said second end of said skin pulling flap member (10) and the user can manually advance and latch said skin pulling flap member (10) in small linear increments, allowing for a micro-fine adjustment resolution of the pull/tension force on the user's skin; drive roller (24) on said manual hair anchor member (20) winds a torsion spring as said skin pulling flap member (10) is pulled through said manual hair anchor member (20) as the drive roller (24) rotates; the pull/tension force on the user's skin is released by pressing flap release button (36) located on the side of said manual hair anchor member (20), that releases the ratchet mechanism for drive roller (24) on said manual hair anchor member (20) and the wound torsion spring unwinds and rotates the drive roller (24), thereby driving said second end of said skin pulling flap member (10) out of said manual hair anchor member (20) and releasing the pull/tension force on the user's skin while moving said skin pulling flap member (10) into a released position; alternately the pull/tension force on the user's skin is released by lifting the handle on shield/guide (28) that moves idler roller (26) away from drive roller (24), thereby releasing the gripping by the rollers on said second end of said skin pulling flap member (10) and also automatically releases the ratchet mechanism for drive roller (24) on said manual hair anchor member (20) and the wound torsion spring unwinds and rotates the drive roller (24), allowing said second end of said skin pulling flap member (10) to freely exit the roller drive system of said manual hair anchor member (20).

16. An electro-mechanical skin pulling device apparatus as recited in claim 1, wherein said second end of said remote control hair anchor member (22) is an enclosure containing subsystems, as follows: 1) roller drive system having two rollers that the flat surface of said second end of said skin pulling flap member (10) is gripped by and rolls between; 2) electric motor with reduction gear system rotates/locks drive roller (24); 3) microcontroller electronics controls all said remote control hair anchor member (22) device functions; 4) RF (radio frequency) transmitter/receiver electronics communicates to wireless mobile communication device or dedicated remote control device (62); 5) sensors to monitor said remote control hair anchor member (22) device functions; and 6) battery to power said remote control hair anchor member (22) device; all subsystems except drive roller (24) and idler roller (26) are enclosed within electromechanical containment area (44) within said second end of said remote control hair anchor member (22); the user attaches said second end of said skin pulling flap member (10) to said remote control hair anchor member (22) by lifting spring loaded shield/guide (28) by a handle on shield/guide (28) that moves idler roller (26) away from drive roller (24), creating an opening that said second end of said skin pulling flap member (10) is routed through by the user; the user then releases the handle on spring loaded shield/guide (28) allowing idler roller (26) to close and press against said second end of said skin pulling flap member (10) and pinching said second end of said skin pulling flap member (10) between idler roller (26) and drive roller (24) with the roller drive system now engaged; drive roller (24) and idler roller (26) when engaged are nearly inline parallel to the direction the pull/tension force is being applied to said second end of said skin pulling flap member (10) thus allowing for the roller drive system in said remote control hair anchor member (22) to be very thin and having the least intrusive height required for said remote control hair anchor member (22); as a safety measure if the pull/tension force on said skin pulling flap member (10) becomes excessive, spring loaded shield/guide (28) will raise up with idler roller (26) pulling away from drive roller (24) and thus losing traction and causing slippage of said second end of said skin pulling flap member (10) against drive roller (24) to limit any further increase in the pull/tension force being exerted on said skin pulling flap member (10); said second end of said skin pulling flap member (10) is driven by drive roller (24) with idler roller (26) pressing against it, being rotated by the electric motor which draws and pulls said second end of said skin pulling flap member (10) into the roller drive system and then back out over the surface of said second end of said remote control hair anchor member (22), thereby exerting the desired pull/tension force on the user's skin through said skin pulling flap member (10) to the attachment point where said skin pulling flap member (10) adheres to the user's skin, such that the user achieves the desired skin alteration; said skin pulling flap member (10) is inserted and pinched into the roller drive system of said remote control hair anchor member (22) anywhere along the length of said second end of said skin pulling flap member (10) and the electric motor can advance and latch said skin pulling flap member (10) in small linear increments, allowing for a micro-fine adjustment resolution of pull/tension force on the user's skin; the electric motor when stopped continues to grip said second end of said skin pulling flap member (10) and since the reduction ratio in the reduction gear system is very high, the drive roller (24) remains stopped in a stationary position, thereby reliably and securely holding said skin pulling flap member (10) fixed and locked between the rollers on said remote control hair anchor member (22) and thus maintaining the desired pull/tension force on the user's skin; reversing the electric motor rotation pushes said second end of said skin pulling flap member (10) back out of said roller drive system and thereby decreasing the pull/tension force on said skin pulling flap member (10) and the user's skin at the attachment point; pressing flap release button (36) button located on the side of said remote control hair anchor member (22) mechanically disengages the drive roller (24) by releasing the pressure holding idler roller (26) against the drive roller (24) if quick disengagement and release of the pull/tension force being exerted on said skin pulling flap member (10) is desired by the user; alternately the pull/tension force on the user's skin is released by lifting the handle on spring loaded shield/guide (28) that moves idler roller (26) away from drive roller (24), thereby releasing the gripping by the rollers on said second end of said skin pulling flap member (10), allowing said second end of said skin pulling flap member (10) to freely exit said roller drive system on said second end of said remote control hair anchor member (22); the methods by which the user can control the electric motor actions, are as follows: 1) pressing a pressure sensitive push button switch (38) located on the outside of said second end of said remote control hair anchor member (22); or 2) remote control using an RF (radio frequency) communication/frequency enabled mobile communication device with security encryption (such as Bluetooth) such as a mobile phone (60); or 3) remote control using an RF (radio frequency) communication/frequency enabled dedicated remote control device (62); the electric motor can perform any of the following actions: 1) increase the pull/tension force on said skin pulling flap member (10) by activating the electric motor and rotating drive roller (24) clockwise; 2) decrease the pull/tension force on said skin pulling flap member (10) by activating the electric motor and rotating drive roller (24) counterclockwise; or 3) deactivate electric motor to lock stationary said skin pulling flap member (10) at the current position; sensors within said remote control hair anchor member (22) allow the microcontroller to monitor said remote control hair anchor member (22) functions, as follows: 1) pressure sensor to measure the pull/tension force being exerted on said skin pulling flap member (10); 2) recognition sensor (42) measures the linear motion, direction and end points of said skin pulling flap member (10); 3) sensor measures the rotation speed and direction of drive roller (24); 4) switch/sensor detects the position of spring loaded shield/guide (28); and 5) sensor measures the internal temperature of the electronics; microcontroller communicates wirelessly with the user's mobile communication device or dedicated remote control device (62) through an RF (radio frequency) electronic transmitter/receiver with an embedded internal chip antenna contained in said remote control hair anchor member (22); an audible noise generator allows the microcontroller to audibly signal the user when prompted to do so by a user's action; one or more batteries are contained within said second end of said remote control hair anchor member (22) that power the electric motor and electronics, with the batteries being removable and replaceable through a latching battery access door (40) at the end of said second end of said remote control hair anchor member (22); microcontroller has power saving circuitry that can measure the remaining energy in the battery and takes measures to minimize power usage to preserve the battery life.

17. An electro-mechanical skin pulling device apparatus as recited in claim 1, wherein said remote control hair anchor member (22) has said first end of said remote control hair anchor member (22) hinged to said second end of said remote control hair anchor member (22) and said first end has an arm extending into said second end of said remote control hair anchor member (22) that presses on a pressure sensor, that allows the microcontroller to measure the pull/tension force being exerted on said skin pulling flap member (10), thereby allowing the microcontroller to automatically set, adjust and maintain the pull/tension force being exerted on said skin pulling flap member (10) at a preset or stored level and as a safety measure to prevent excessive pull/tension force from being applied to said skin pulling flap member (10).

18. An electro-mechanical skin pulling device apparatus as recited in claim 1, wherein said remote control hair anchor member (22) has recognition sensor (42) located on the outside of said second end of said remote control hair anchor member (22) that measures the linear motion of said skin pulling flap member (10), by detecting a series of bar code markings (14) imprinted or molded onto said second end of said skin pulling flap member (10) surface as said skin pulling flap member (10) slides over recognition sensor (42), to enable the microcontroller to measure the linear motion, direction and end points of said second end of said skin pulling flap member (10); shield/guide (28) keeps said second end of said skin pulling flap member (10) sliding in close proximity to recognition sensor (42) that detects the linear motion of said skin pulling flap member (10), as it exits the roller drive system and as said skin pulling flap member (10) moves out over the outer surface of said second end of said remote control hair anchor member (22).

19. An electro-mechanical skin pulling device apparatus as recited in claim 1, wherein said remote control hair anchor member (22) enables the user to interact with said remote control hair anchor member (22), as follows: 1) pressing a pressure sensitive push button switch (38) located on the outside of said second end of said remote control hair anchor member (22) by using a specific series of sequential switch closures while prompted by the audible sound emitted by said remote control hair anchor member (22); or 2) remote control using an RF (radio frequency) communication/frequency enabled wireless mobile communication device with security encryption (like Bluetooth) such as a mobile phone (60) running an application for the electro-mechanical skin pulling device permits the user to adjust the pull/tension force being exerted on the user's skin at a specified location on the user's face/neck using buttons on the mobile communication device's screen while simultaneously watching the alteration actually occurring on their face/neck overlaid on the mobile communication device's display screen as if looking into a mirror, without the user ever having to even touch the user's hair or face and communicating with and controlling up to 16 said skin pulling flap member (10)/said remote control hair anchor member (22) pairs simultaneously on the user, with said remote control hair anchor member (22) notifying the user of issues like low battery or other diagnostic monitoring by transmitting the status to the user's mobile communication device; or 3) remote control using an RF (radio frequency) communication/frequency enabled dedicated remote control device (62) permits the user to adjust the pull/tension force being exerted on the user's skin at a specified location on the user's face/neck without the user having to even touch the user's hair or face and communicating with and controlling up to 16 said skin pulling flap member (10)/said remote control hair anchor member (22) pairs simultaneously on the user, with said remote control hair anchor member (22) notifying the user of issues like low battery or other diagnostic monitoring by transmitting the status to the dedicated remote control device (62) to alert the user of the issue; each said remote control hair anchor member (22) is synchronized with the user's mobile communication device or dedicated remote control device (62) by the user pressing the external pressure sensitive switch (38) on said second end of said remote control hair anchor member (22) to transmit a registration code for the location of said remote control hair anchor member (22) on the user's head/neck and the communication ID of that particular said remote control hair anchor member (22) to the user's mobile communication device or dedicated remote control device (62).

20. An electro-mechanical skin pulling device apparatus as recited in claim 1, wherein said skin pulling flap member (10) directly transmits the pulling/tension force point to point between said first end of said skin pulling flap member (10) secured to the user's skin, to said manual hair anchor member (20) or to said remote control hair anchor member (22) that is secured to the user's hair close to the user's scalp as the final end anchoring point; said skin pulling flap member (10) connected to said manual hair anchor member (20) or to said remote control hair anchor member (22) when worn by the user inclusively has a small physical size with an overall length of less than four inches and a width of less than 0.75 inches and requiring no counter force mechanism such as a band or strap around the user's head; said skin pulling flap member (10) connected to said manual hair anchor member (20) or to said remote control hair anchor member (22) when worn by the user inclusively has a small physical size that is easier to hide and disguise by the user and can be used with shorter user hairstyles with user hair as short as two inches in length.

21. An electro-mechanical skin pulling device apparatus as recited in claim 1, wherein said skin pulling flap member (10) directly transmits the pulling/tension force point to point between said first end of said skin pulling flap member (10) secured to the user's skin, to said manual hair anchor member (20) or to said remote control hair anchor member (22) that is secured to the user's hair close to the user's scalp as the final end anchoring point; such that the pull/tension force exerted on the user's skin can be applied in both a vertical and horizontal direction of the user's choice, by securing said manual hair anchor member (20) or said remote control hair anchor member (22) to the user's hair anywhere within a 170 degree arc surrounding the point that said first end of said skin pulling flap member (10) is attached to the user's skin, to achieve the user's desired skin alteration.

22. An electro-mechanical skin pulling device apparatus as recited in claim 1, wherein said skin pulling flap member (10) directly transmits the pulling/tension force point to point between said first end of said skin pulling flap member (10) secured to the user's skin, to said manual hair anchor member (20) or to said remote control hair anchor member (22) that is secured to the user's hair close to the user's scalp as the final end anchoring point; allowing said first end of said skin pulling flap member (10) to be attached on bare skin anywhere along the hairline on the face and neck; that is said skin pulling flap member (10) and said manual hair anchor member (20) or said remote control hair anchor member (22) can be placed most anywhere around the user's head/neck to alter facial features including forehead, eyes, eyebrows, crow's feet wrinkles around the eyes, nasolabial folds, cheek wrinkles and neck/throat features such as turkey neck, sagging jaw, crepey skin and specific user features such as elongation of the eyes.

23. An electro-mechanical skin pulling device apparatus as recited in claim 1, further comprising said first end of said manual hair anchor member (20) or said first end of said remote control hair anchor member (22) that functions to grasp onto the user's hair and serve as a fixed anchor point, can be solely separated and incorporated into other applications and into other anchoring devices such as clips, clasps, barrettes, head bands, wigs, toupees or other hair attachment/anchoring devices.

24. An electro-mechanical skin pulling device apparatus as recited in claim 1, further comprising said second end of said manual hair anchor member (20) or said second end of said remote control hair anchor member (22) that functions to grasp said second end of said skin pulling flap member (10) and apply more or less pull/tension force to said skin pulling flap member (10) or to maintain the current pull/tension force on said skin pulling flap member (10), can be solely separated and incorporated into other applications and into other skin altering and anchoring devices such as clips, clasps, barrettes, head bands, wigs, toupees or other hair attachment/anchoring devices.

25. An electro-mechanical skin pulling device apparatus as recited in claim 1, further comprising the mechanism of said first end of said manual hair anchor member (20) and said first end of said remote control hair anchor member (22) and the mechanism of said second end of said manual hair anchor member (20) and said second end of said remote control hair anchor member (22), can be solely separated and multiples of either mechanism or in combination, can be incorporated onto and into one wearable device such as other skin altering and anchoring devices, clips, clasps, barrettes, head bands, wigs, toupees or other hair attachment/anchoring devices and can optionally accept simultaneous attachment and control of one or more said skin pulling flap members (10) with a single wearable anchoring device.

26. An electro-mechanical skin pulling device apparatus as recited in claim 1, further comprising an alternate design for said second end of said manual hair anchor member (20) is shown in FIG. 9 depicting manual hair anchor member (50) where the roller drive system is removed from said manual hair anchor member (20) and replaced with a friction gripping system in said second end of said manual hair anchor member (50) consisting of cylindrical depression (52) in said manual hair anchor member (50) that has an outer rough contact surface (56) and the curved contact surface of spring loaded shield/guide (54) has an outer rough contact surface (56) such that when spring loaded shield/guide (54) is closed and engaged, said second end of said skin pulling flap member (10) is pressed into cylindrical depression (52) and pinched between the rough contact surface (56) of cylindrical depression (52) and the rough contact surface (56) of the curved contact surface of spring loaded shield/guide (54), such that said skin pulling flap member (10) is securely held fixed in position and thus maintaining the desired pull/tension force on the user's skin through said skin pulling flap member (10); shield/guide (54) also prevents user hair from entering the friction gripping system and helps guide said skin pulling flap member (10) into the friction gripping system on said first end of said manual hair anchor member (50) and then guides said skin pulling flap member (10) to exit the friction gripping system back out over said second end of said manual hair anchor member (50); the user attaches said second end of said skin pulling flap member (10) to said manual hair anchor member (50) by lifting spring loaded shield/guide (54) by a handle on shield/guide (54) that moves the curved contact surface of shield/guide (54) away from cylindrical depression (52) on said manual hair anchor member (50), creating an opening that said second end of said skin pulling flap member (10) is routed through by the user; the user then releases the handle on shield/guide (54) allowing the curved contact surface on spring loaded shield/guide (54) to close and press against said second end of said skin pulling flap member (10) and pinching said second end of said skin pulling flap member (10) between the curved contact surface on shield/guide (54) and the cylindrical depression on said manual hair anchor member (50) with the friction gripping system now engaged; shield/guide (54) when engaged is very low profile thus allowing said manual hair anchor member (50) to be very thin and having the least intrusive height required for said manual hair anchor member (50); as a safety measure if the pull/tension force on said skin pulling flap member (10) becomes excessive, spring loaded shield/guide (54) will raise up with the curved contact surface on shield/guide (54) pulling away from the cylindrical depression (52) on said manual hair anchor member (50) and thus losing traction and causing slippage of said second end of said skin pulling flap member (10) against friction surfaces (56) to limit any further increase in the pull/tension force being exerted on said skin pulling flap member (10); said second end of said skin pulling flap member (10) is pulled by the user, moving between the curved contact surface of shield/guide (54) and cylindrical depression (52) on said manual hair anchor member (50) and when said skin pulling flap member (10) is released by the user, the curved contact surface on spring loaded shield/guide (54) presses said skin pulling flap member (10) back into the cylindrical depression (52) on said manual hair anchor member (50) grasping and holding stationary said second end of said skin pulling flap member (10), thereby reliably and securely holding said skin pulling flap member (10) fixed stationary and exerting the desired pull/tension force on the user's skin through said skin pulling flap member (10) to the attachment point where said skin pulling flap member (10) adheres to the user's skin, such that the user achieves the desired skin alteration; said skin pulling flap member (10) is inserted and pinched into the friction gripping system of said manual hair anchor member (50) anywhere along the length of said second end of said skin pulling flap member (10) and the user can manually advance and latch said skin pulling flap member (10) in small linear increments, allowing for a micro-fine adjustment resolution of the pull/tension force on the user's skin; the pull/tension force on the user's skin is released by pressing flap release button (36) located on the side of said manual hair anchor member (50), that causes the curved contact surface of shield/guide (54) to move away from the cylindrical depression (52) on said manual hair anchor member (50) thereby releasing the grip on said skin pulling flap member (10) and releasing the pull/tension force on the user's skin; alternately the pull/tension force on the user's skin is released by lifting the handle on spring loaded shield/guide (54) that moves the curved contact surface on shield/guide (54) away from cylindrical depression (52) on said manual hair anchor member (50), thereby releasing the gripping on said second end of said skin pulling flap member (10), allowing said second end of said skin pulling flap member (10) to release and freely exit the friction gripping system of said manual hair anchor member (50).

27. An electro-mechanical skin pulling device apparatus as recited in claim 1, further comprising dedicated remote control device (62) can be embedded into other complimentary cosmetic devices, both fixed, portable and foldable, such as a cosmetic makeup case, cosmetic tote bag or cosmetic compact makeup case (64) that contains dedicated remote control device (62) and any of the following example features: 1) mirror for viewing the user's face, neck and hair; 2) viewing lighting that lights-up the user's face, neck and hair; 3) cosmetic makeup; 4) cosmetic tools like brushes/applicators; 5) other cosmetic/hair/personal items; and 6) spare electro-mechanical skin pulling device apparatus items; thus permitting the user to adjust the skin pull/tension force being applied to their face and neck using the built-in dedicated remote controller (62) while simultaneously watching the adjustment actually occurring on their face and/or neck in the mirror contained in their cosmetic case device.

* * * * *